US007622247B2

(12) United States Patent
Ramsden et al.

(10) Patent No.: US 7,622,247 B2
(45) Date of Patent: Nov. 24, 2009

(54) PROTECTIVE OVERCOATS FOR THERMALLY DEVELOPABLE MATERIALS

(75) Inventors: William Donald Ramsden, Afton, MN (US); Chaofeng Zou, Maplewood, MN (US); Doreen Catherine Lynch, Afton, MN (US); Stacy Marie Ulrich, Dresser, WI (US); Sharon Mary Simpson, Lake Elmo, MN (US)

(73) Assignee: Carestream Health, Inc., Rochester, NY (US)

( * ) Notice: Subject to any disclaimer, the term of this patent is extended or adjusted under 35 U.S.C. 154(b) by 17 days.

(21) Appl. No.: 12/013,505

(22) Filed: Jan. 14, 2008

(65) Prior Publication Data

US 2009/0181332 A1 Jul. 16, 2009

(51) Int. Cl.
*G03C 1/00* (2006.01)
*G03C 1/005* (2006.01)
*G03C 1/494* (2006.01)

(52) U.S. Cl. ..... 430/619; 430/617; 430/618; 430/620; 430/631; 430/641; 430/905; 430/911; 430/964

(58) Field of Classification Search ..... 430/617–620, 430/631, 641, 905, 911, 964
See application file for complete search history.

(56) References Cited

U.S. PATENT DOCUMENTS 1,623,499 A 4/1927 Sheppard et al.
2,131,038 A 9/1938 Brooker et al.
2,399,083 A 4/1946 Waller et al.
2,444,605 A 7/1948 Heimnach et al.
2,489,341 A 11/1949 Waller et al.
2,565,418 A 8/1951 Yackel
2,566,263 A 8/1951 Trivelli et al.
2,588,765 A 3/1952 Robijns et al.
2,597,915 A 5/1952 Yutzy et al.
2,614,928 A 10/1952 Yutzy et al.
2,618,556 A 11/1952 Hewitson et al.
2,681,294 A 6/1954 Beguin
2,694,716 A 11/1954 Allen et al.
2,701,245 A 2/1955 Lynn et al.
2,761,791 A 9/1956 Russell
2,785,993 A 3/1957 Paist et al.
2,839,405 A 6/1958 Jones et al.
2,861,065 A 11/1958 Minsk et al.
2,886,437 A 5/1959 Piper et al.
2,960,404 A 11/1960 Milton et al.
2,992,101 A 7/1961 Jelley et al.
3,074,809 A 1/1963 Owen
3,080,254 A 3/1963 Grant, Jr.
3,094,417 A 6/1963 Workman
3,121,060 A 2/1964 Duane
3,206,312 A 9/1965 Sterman et al.
3,220,839 A 11/1965 Herz et al.
3,235,652 A 2/1966 Lindsey
3,241,969 A 3/1966 Hart et al.
3,287,135 A 11/1966 Anderson et al.
3,297,446 A 1/1967 Dunn
3,297,447 A 1/1967 McVeigh
3,330,663 A 7/1967 Weyde et al.
3,428,451 A 2/1969 Trevoy
3,446,648 A 5/1969 Workman
3,457,075 A 7/1969 Morgan et al.
3,700,458 A 10/1972 Lindholm
3,719,495 A 3/1973 Lea
3,785,830 A 1/1974 Sullivan et al.
3,832,186 A 8/1974 Masuda et al.
3,839,049 A 10/1974 Simons
3,844,797 A 10/1974 Willems et al.
3,847,612 A 11/1974 Winslow
3,874,946 A 4/1975 Costa et al.
3,887,417 A 6/1975 Davies
3,933,508 A 1/1976 Ohkubo et al.
3,951,660 A 4/1976 Hagemann
3,985,565 A 10/1976 Gabrielsen et al.
4,001,024 A 1/1977 Dittman et al.
4,030,931 A 6/1977 Noguchi et al.
4,076,539 A 2/1978 Ikenoue et al.
4,082,901 A 4/1978 Laridon et al.
4,123,274 A 10/1978 Knight et al.
4,123,282 A 10/1978 Winslow
4,196,002 A 4/1980 Levinson et al.
4,302,523 A 11/1981 Audran et al.
4,396,712 A 8/1983 Kinoshita et al.
4,439,520 A 3/1984 Kofron et al.
4,452,883 A 6/1984 Frenchik et al.
4,504,575 A 3/1985 Lee
4,524,128 A 6/1985 Edwards et al.
4,569,863 A 2/1986 Koepke et al.
4,581,329 A 4/1986 Sugimoto et al.
4,582,786 A 4/1986 Ikeda et al.
4,609,621 A 9/1986 Sugimoto et al.
4,675,279 A 6/1987 Shuto et al.
4,678,741 A 7/1987 Yamada et al.
4,690,883 A 9/1987 Kubodera et al.
4,720,451 A 1/1988 Shuto et al.
4,741,992 A 5/1988 Przezdziecki
4,761,361 A 8/1988 Ozaki et al.

(Continued)

FOREIGN PATENT DOCUMENTS

EP 0 227 141 11/1986

(Continued)

OTHER PUBLICATIONS

Ulrich et al., "Thermally Developable Materials Containing Reducing Agent Combinations", U.S. Appl. No. 11/507,550, filed Aug. 21, 2006.

(Continued)

*Primary Examiner*—Geraldina Visconti

(57) ABSTRACT

Mixtures of an alkyl vinyl ether/maleic anhydride copolymer or an alkylethylene/maleic anhydride copolymer with cellulose acetate provide protective overcoats for thermally developable materials. These protective overcoats exhibit good adhesion to the emulsion layer, are physically hard, and have good optical clarity while maintaining the sensitometric properties of the materials.

29 Claims, No Drawings

U.S. PATENT DOCUMENTS

| | | | |
|---|---|---|---|
| 4,775,613 | A | 10/1988 | Hirai et al. |
| 4,784,939 | A | 11/1988 | Van Pham |
| 4,818,675 | A | 4/1989 | Miyasaka et al. |
| 4,840,882 | A | 6/1989 | Iwagaki et al. |
| 4,873,184 | A | 10/1989 | Simpson |
| 4,945,036 | A | 7/1990 | Arai et al. |
| 4,952,491 | A | 8/1990 | Nishikawa et al. |
| 5,028,523 | A | 7/1991 | Skoug |
| 5,049,485 | A | 9/1991 | Deaton |
| 5,064,753 | A | 11/1991 | Sohei et al. |
| 5,135,842 | A | 8/1992 | Kitchin et al. |
| 5,149,620 | A | 9/1992 | Simpson et al. |
| 5,158,866 | A | 10/1992 | Simpson et al. |
| 5,175,081 | A | 12/1992 | Krepski et al. |
| 5,250,386 | A | 10/1993 | Aono et al. |
| 5,252,455 | A | 10/1993 | Deaton |
| 5,266,452 | A | 11/1993 | Kitchin et al. |
| 5,281,515 | A | 1/1994 | Delprato et al. |
| 5,298,390 | A | 3/1994 | Sakizadeh et al. |
| 5,300,420 | A | 4/1994 | Kenney et al. |
| 5,310,640 | A | 5/1994 | Markin et al. |
| 5,314,795 | A | 5/1994 | Helland et al. |
| 5,340,613 | A | 8/1994 | Hanzalik et al. |
| 5,358,843 | A | 10/1994 | Sakizadeh et al. |
| 5,368,979 | A | 11/1994 | Freedman et al. |
| 5,368,995 | A | 11/1994 | Christian et al. |
| 5,369,000 | A | 11/1994 | Sakizadeh et al. |
| 5,374,514 | A | 12/1994 | Kirk et al. |
| 5,380,635 | A | 1/1995 | Gomez et al. |
| 5,382,504 | A | 1/1995 | Shor et al. |
| 5,391,727 | A | 2/1995 | Deaton |
| 5,393,654 | A | 2/1995 | Burrows et al. |
| 5,405,740 | A | 4/1995 | LaBelle |
| 5,415,993 | A | 5/1995 | Hanzalik et al. |
| 5,434,043 | A | 7/1995 | Zou et al. |
| 5,441,866 | A | 8/1995 | Miller et al. |
| 5,460,938 | A | 10/1995 | Kirk et al. |
| 5,464,747 | A | 11/1995 | Eisenbeis et al. |
| 5,468,603 | A | 11/1995 | Kub |
| 5,491,059 | A | 2/1996 | Whitcomb |
| 5,493,327 | A | 2/1996 | McCallum et al. |
| 5,508,162 | A | 4/1996 | Dankosh |
| 5,510,236 | A | 4/1996 | Dankosh |
| 5,525,376 | A | 6/1996 | Leonard |
| 5,532,121 | A | 7/1996 | Yonkoski et al. |
| 5,541,054 | A | 7/1996 | Miller et al. |
| 5,545,505 | A | 8/1996 | Simpson |
| 5,545,507 | A | 8/1996 | Simpson et al. |
| 5,558,983 | A | 9/1996 | Simpson et al. |
| 5,594,143 | A | 1/1997 | Kirk et al. |
| 5,599,647 | A | 2/1997 | Defieuw et al. |
| 5,621,983 | A | 4/1997 | Lundemann et al. |
| 5,637,449 | A | 6/1997 | Harring et al. |
| 5,652,091 | A | 7/1997 | Perry et al. |
| 5,672,562 | A | 9/1997 | Goswami et al. |
| 5,686,228 | A | 11/1997 | Murray et al. |
| 5,691,127 | A | 11/1997 | Daubendiek et al. |
| 5,716,772 | A | 2/1998 | Taguchi |
| 5,733,608 | A | 3/1998 | Kessel et al. |
| 5,759,761 | A | 6/1998 | Lushington et al. |
| 5,780,207 | A | 7/1998 | Mohapatra et al. |
| 5,795,708 | A | 8/1998 | Boutet |
| 5,804,365 | A | 9/1998 | Bauer et al. |
| 5,843,530 | A | 12/1998 | Jerry et al. |
| 5,849,363 | A | 12/1998 | Yapel et al. |
| 5,861,195 | A | 1/1999 | Bhave et al. |
| 5,891,610 | A | 4/1999 | Bauer et al. |
| 5,891,615 | A | 4/1999 | Winslow et al. |
| 5,912,111 | A | 6/1999 | Lok et al. |
| 5,928,857 | A | 7/1999 | Geisler et al. |
| 5,939,249 | A | 8/1999 | Zou |
| 5,968,725 | A | 10/1999 | Katoh et al. |
| 5,981,151 | A | 11/1999 | Leenders et al. |
| 6,013,420 | A | 1/2000 | Wingender et al. |
| 6,063,560 | A | 5/2000 | Suzuki et al. |
| 6,083,681 | A | 7/2000 | Lynch et al. |
| 6,090,538 | A | 7/2000 | Arai et al. |
| 6,143,487 | A | 11/2000 | Philip et al. |
| 6,146,822 | A | 11/2000 | Asanuma et al. |
| 6,150,084 | A | 11/2000 | Ito et al. |
| 6,165,704 | A | 12/2000 | Miyake et al. |
| 6,171,767 | B1 | 1/2001 | Kong et al. |
| 6,190,822 | B1 | 2/2001 | Dickerson et al. |
| 6,190,854 | B1 | 2/2001 | Sampei |
| 6,203,972 | B1 | 3/2001 | Katoh et al. |
| 6,306,566 | B2 | 10/2001 | Sakurada et al. |
| 6,355,405 | B1 | 3/2002 | Ludemann et al. |
| 6,355,408 | B1 | 3/2002 | Whitcomb et al. |
| 6,368,778 | B1 | 4/2002 | Kong et al. |
| 6,368,779 | B1 | 4/2002 | Lynch et al. |
| 6,413,710 | B1 | 7/2002 | Shor et al. |
| 6,413,712 | B1 | 7/2002 | Yoshioka et al. |
| 6,423,481 | B1 | 7/2002 | Simpson et al. |
| 6,436,616 | B1 | 8/2002 | Geisler et al. |
| 6,440,649 | B1 | 8/2002 | Simpson et al. |
| 6,455,210 | B1 | 9/2002 | Irving et al. |
| 6,465,162 | B1 | 10/2002 | Kong et al. |
| 6,472,131 | B1 | 10/2002 | Whitcomb |
| 6,475,710 | B2 | 11/2002 | Kudo et al. |
| 6,485,898 | B2 | 11/2002 | Yoshioka et al. |
| 6,514,677 | B1 | 2/2003 | Ramsden et al. |
| 6,514,684 | B2 | 2/2003 | Suzuki et al. |
| 6,548,240 | B2 | 4/2003 | Yamaguchi |
| 6,558,880 | B1 | 5/2003 | Goswami et al. |
| 6,566,042 | B1 | 5/2003 | Goto et al. |
| 6,573,033 | B1 | 6/2003 | Simpson et al. |
| 6,599,685 | B1 | 7/2003 | Kong |
| 6,620,577 | B1 | 9/2003 | Lynch et al. |
| 6,620,582 | B2 | 9/2003 | Hirabayashi |
| 6,630,283 | B1 | 10/2003 | Simpson et al. |
| 6,645,714 | B2 | 11/2003 | Oya et al. |
| 6,689,546 | B1 | 2/2004 | LaBelle et al. |
| 6,689,547 | B2 | 2/2004 | Hunt et al. |
| 6,699,647 | B2 | 3/2004 | Lynch et al. |
| 6,699,648 | B2 | 3/2004 | Sakizadeh et al. |
| 6,699,649 | B2 | 3/2004 | Nishijima et al. |
| 6,713,240 | B2 | 3/2004 | Lynch et al. |
| 6,762,013 | B2 | 7/2004 | Sakizadeh et al. |
| 6,764,385 | B2 | 7/2004 | Boumerzoug et al. |
| 6,787,298 | B2 | 9/2004 | Goto et al. |
| 6,803,177 | B2 | 10/2004 | Bokhonov et al. |
| 6,841,343 | B2 | 1/2005 | Lynch et al. |
| 6,942,960 | B2 | 9/2005 | Maskasky et al. |
| 6,977,139 | B2 | 12/2005 | Hasberg et al. |
| 7,008,748 | B1 | 3/2006 | Hasberg et al. |
| 7,018,787 | B1 | 3/2006 | Ludemann et al. |
| 7,022,467 | B1 | 4/2006 | Ludemann et al. |
| 7,026,105 | B2 | 4/2006 | Simpson et al. |
| 7,063,941 | B2 | 6/2006 | Burleva et al. |
| 7,067,242 | B2 | 6/2006 | Ludemann et al. |
| 7,074,549 | B2 | 7/2006 | Simpson et al. |
| 7,087,364 | B2 | 8/2006 | Ludemann et al. |
| 7,087,366 | B2 | 8/2006 | Burleva et al. |
| 7,129,032 | B2 | 10/2006 | Mori et al. |
| 7,144,689 | B2 | 12/2006 | Ludemann et al. |
| 7,153,636 | B1 | 12/2006 | Ludemann et al. |
| 7,169,543 | B2 | 1/2007 | Ramsden et al. |
| 7,169,544 | B2 | 1/2007 | Chen-Ho et al. |
| 7,192,695 | B2 | 3/2007 | Sakai et al. |
| 7,241,561 | B1 | 7/2007 | Lynch et al. |
| 7,255,982 | B1 | 8/2007 | Chen-Ho et al. |
| 7,258,967 | B1 | 8/2007 | Sakizadeh et al. |
| 7,261,999 | B2 | 8/2007 | Hunt et al. |
| 7,267,934 | B2 | 9/2007 | Goto |

| | | | | |
|---|---|---|---|---|
| 7,267,935 | B1 | 9/2007 | Simpson et al. | |
| 2005/0214702 | A1 | 9/2005 | Ohgeki | |
| 2006/0141404 | A1 | 6/2006 | Philip, Jr. et al. | |
| 2006/0216660 | A1* | 9/2006 | Oyamada et al. | 430/619 |
| 2006/0240367 | A1 | 10/2006 | Teranishi | |

FOREIGN PATENT DOCUMENTS

| | | |
|---|---|---|
| EP | 0 342 810 | 11/1989 |
| EP | 0 559 228 | 3/1993 |
| EP | 0 600 586 | 9/1993 |
| EP | 0 600 587 | 9/1993 |
| EP | 0 678 776 | 10/1995 |
| EP | 0 600 587 | 2/1996 |
| EP | 0 821 271 | 6/1997 |
| EP | 0 915 371 | 10/1998 |
| EP | 1 083 459 | 3/2001 |
| GB | 623448 | 7/1946 |
| GB | 837 095 | 6/1960 |
| GB | 955061 | 6/1962 |
| GB | 1 439 478 | 12/1973 |
| GB | 1 565 043 | 3/1978 |
| JP | 49-13224 | 2/1974 |
| JP | 50-17216 | 2/1975 |
| JP | 51-42529 | 4/1976 |
| JP | 11-302550 | 11/1999 |
| JP | 2000-029168 | 1/2000 |
| JP | 2000-63690 | 2/2000 |
| JP | 2000-112054 | 4/2000 |
| JP | 2000-273329 | 10/2000 |
| JP | 2001-5145 | 1/2001 |
| JP | 2001-51371 | 2/2001 |
| JP | 2001-64527 | 3/2001 |
| JP | 2001-109101 | 4/2001 |
| JP | 2001-142175 | 5/2001 |
| JP | 2001-154305 | 6/2001 |
| JP | 2001-183770 | 7/2001 |

OTHER PUBLICATIONS

Zou et al., Photothermographic Materials Containing Developer and Co-Developer, U.S. Appl. No. 11/611,913, filed Dec. 18, 2006.

Zou et al., Photothermographic Materials Containing Developer and Co-Developer, U.S. Appl. No. 11/735,530, filed Apr. 16, 2007.

Brinckman et al., Unconventional Imaging Processes, The Focal Press, London and New York, 1978, pp. 74-74.

D. H. Klosterboer, Thermally Processed Silver Systems, Van Nostrand-Reinhold, New York, 1989, Chapter 9, pp. 279-291.

Zou et al., Mechanisms of Latent Image Formation in Photothermographic Silver Imaging Media, Journal of Imaging Science and Technology, vol. 40, No. 2, pp. 94-103, Mar./Apr. 1996.

T.H. James, "The Theory of the Photographic Process," Fourth Edition, Eastman Kodak, Rochester, NY, 1977, p. 374.

T.H. James, "The Theory of the Photographic Process," Fourth Edition, Eastman Kodak, Rochester, NY, 1977, Chapter 5, pp. 149-169.

T.H. James, "The Theory of the Photographic Process," Fourth Edition, Eastman Kodak, Rochester, NY, 1977, Chapter 2, pp. 77-78.

T.H. James, "The Theory of the Photographic Process," Third Edition, Macmillan, NY, 1966, Chapter 2.

Y. Yoshioka et al., "Development of Rapid Dry Photothermographic Materials with Water-Base Emulsion Coating Method," AgX 2004: The International Symposium on Silver Halide Technology "At the Forefront of Silver Halide Imaging", Final Program and Proceedings of IS&T and SPSTJ, Ventura, CA, Sep. 13-15, 2004, pp. 28-31.

U.S. Appl. No. 11/859,094, filed Sep. 21, 2007, entitled: Method of Preparing Silver Carboxylate Soaps, by Burleva et al.

U.S. Appl. No. 11/858,984, filed Sep. 21, 2007, entitled: Processing Latitude Stabilizers for Photothermographic Materials.

R. A. Elder, "Resistivity Measurements on Buried Conductive Layers," EOS/ESD Symposium Proceedings, Lake Buena Vista, FL, 1990, pp. 251-254.

Particle Size Analysis, ASTM Symposium on Light Microscopy, R. P. Loveland, 1955, pp. 94-122.

Research Disclosure 17029.

Research Disclosure 308119.

Research Disclosure 36544.

Research Disclosure 22812.

Research Disclosure 23419.

Research Disclosure 38957.

Research Disclosure 34390.

* cited by examiner

PROTECTIVE OVERCOATS FOR THERMALLY DEVELOPABLE MATERIALS

FIELD OF THE INVENTION

This invention relates to protective overcoats for thermally developable materials such as thermographic and photothermographic materials. This invention also relates to methods of imaging and using thermally developable materials having these overcoats.

BACKGROUND OF THE INVENTION

Silver-containing thermographic and photothermographic imaging materials (that is, thermally developable imaging materials) that are imaged and/or developed using heat and without liquid processing have been known in the art for many years.

Silver-containing direct thermographic imaging materials are non-photosensitive materials that are used in a recording process wherein images are generated by the direct application of thermal energy and in the absence of a processing solvent. These materials generally comprise a support having disposed thereon (a) a relatively or completely non-photosensitive source of reducible silver ions, (b) a reducing composition (acting as a black-and-white silver developer) for the reducible silver ions, and (c) a suitable binder. Thermographic materials are sometimes called "direct thermal" materials in the art because they are directly imaged by a source of thermal energy without any transfer of the image or image-forming materials to another element (such as in thermal dye transfer).

In a typical thermographic construction, the image-forming thermographic layers comprise non-photosensitive reducible silver salts of long chain fatty acids. A preferred non-photosensitive reducible silver source is a silver salt of a long chain aliphatic carboxylic acid having from 10 to 30 carbon atoms, such as behenic acid or mixtures of acids of similar molecular weight. At elevated temperatures, the silver of the silver carboxylate is reduced by a reducing agent for silver ion (also known as a developer), whereby an image of elemental silver is formed. Preferred reducing agents include methyl gallate, hydroquinone, substituted-hydroquinones, hindered phenols, catechols, pyrogallol, ascorbic acid, and ascorbic acid derivatives.

Some thermographic constructions are imaged by contacting them with the thermal head of a thermographic recording apparatus such as a thermal print-head of a thermal printer or thermal facsimile. In such constructions, an anti-stick layer is coated on top of the imaging layer to prevent sticking of the thermographic construction to the thermal head of the apparatus used. The resulting thermographic construction is then heated imagewise to an elevated temperature, typically in the range of from about 60 to about 225° C., resulting in the formation of a black-and-white image.

Silver-containing photothermographic imaging materials (that is, photosensitive thermally developable imaging materials) that are imaged with actinic radiation and then developed using heat and without liquid processing, have also been known in the art for many years. Such materials are used in a recording process wherein an image is formed by imagewise exposure of the photothermographic material to specific electromagnetic radiation (for example, X-radiation, or ultraviolet, visible, or infrared radiation) and developed by the use of thermal energy. These materials, also known as "dry silver" materials, generally comprise a support having coated thereon: (a) a photocatalyst (that is, a photosensitive compound such as silver halide) that upon such exposure provides a latent image in exposed grains that are capable of acting as a catalyst for the subsequent formation of a silver image in a development step, (b) a relatively or completely non-photosensitive source of reducible silver ions, (c) a reducing composition (acting as a developer) for the reducible silver ions, and (d) a binder. The latent image is then developed by application of thermal energy.

In photothermographic materials, exposure of the photosensitive silver halide to light produces small clusters containing silver atoms $(Ag^0)_n$. The imagewise distribution of these clusters, known in the art as a latent image, is generally not visible by ordinary means. Thus, the photosensitive material must be further developed to produce a visible image. This is accomplished by the reduction of silver ions that are in catalytic proximity to silver halide grains bearing the silver-containing clusters of the latent image. This produces a black-and-white image. The non-photosensitive silver source is catalytically reduced to form the visible black-and-white negative image of silver while much of the silver halide, generally, remains as silver halide and is not reduced.

In photothermographic materials, a typical non-photosensitive reducible silver source is a silver salt of a long chain aliphatic carboxylic acid having from 10 to 30 carbon atoms, such as behenic acid or mixtures of acids of similar molecular weight. At elevated temperatures, the silver of the silver carboxylate is reduced by a reducing agent for silver ion (also known as a developer), whereby elemental silver is formed. The reducing agent for the reducible silver ions, often referred to as a "developer", may be any compound that, in the presence of the latent image, can reduce silver ion to metallic silver and is usually of relatively low activity until it is heated to a temperature sufficient to cause the reaction. A wide variety of classes of compounds have been disclosed in the literature that function as reducing agents for photothermographic materials. Upon heating, and at elevated temperatures, the reducible silver ions are reduced by the reducing agent. This reaction occurs preferentially in the regions surrounding the latent image and produces a negative image of metallic silver having a color that ranges from yellow to deep black depending upon the presence of toning agents and other components in the photothermographic imaging layer(s).

Differences Between Photothermography and Photography:

The imaging arts have long recognized that the field of photothermography is clearly distinct from that of photography. Photothermographic materials differ significantly from conventional silver halide photographic materials that require processing with aqueous processing solutions.

In photothermographic imaging materials, a visible image is created in the absence of a processing solvent by heat as a result of the reaction of a reducing agent incorporated within the material. Heating at 50° C. or more is essential for this dry development. In contrast, conventional photographic imaging materials require processing in aqueous processing baths at more moderate temperatures (from 30° C. to 50° C.) to provide a visible image.

In photothermographic materials, only a small amount of silver halide is used to capture light and a non-photosensitive source of reducible silver ions (for example, a silver carboxylate or a silver benzotriazole) is used to generate the visible image using thermal development. Thus, the imaged photosensitive silver halide serves as a catalyst for the physical development process involving the non-photosensitive source of reducible silver ions and the incorporated reducing agent. In contrast, conventional wet-processed, black-and-white photographic materials use only one form of silver (that is, silver halide) that, upon chemical development, is itself at least partially converted into the silver image, or that upon physical development requires addition of an external silver source (or other reducible metal ions that form black images upon reduction to the corresponding metal). Thus, photothermographic materials require an amount of silver halide per unit area that is only a fraction of that used in conventional wet-processed photographic materials.

In photothermographic materials, all of the "chemistry" for imaging is incorporated within the material itself. For example, such materials include a reducing agent (that is, a developer for the reducible silver ions) while conventional photographic materials usually do not. The incorporation of the reducing agent into photothermographic materials can lead to increased formation of various types of "fog" or other undesirable sensitometric side effects. Therefore, much effort has gone into the preparation and manufacture of photothermographic materials to minimize these problems.

Moreover, in photothermographic materials, the unexposed silver halide generally remains intact after development and the material must be stabilized against further imaging and development. In contrast, silver halide is removed from conventional photographic materials after solution development to prevent further imaging (that is in the aqueous fixing step).

Because photothermographic materials require dry thermal processing, they present distinctly different problems and require different materials in manufacture and use, compared to conventional, wet-processed silver halide photographic materials. Additives that have one effect in conventional silver halide photographic materials may behave quite differently when incorporated in photothermographic materials where the underlying chemistry is significantly more complex. The incorporation of such additives as, for example, stabilizers, antifoggants, speed enhancers, supersensitizers, and spectral and chemical sensitizers in conventional photographic materials is not predictive of whether such additives will prove beneficial or detrimental in photothermographic materials. For example, it is not uncommon for a photographic antifoggant useful in conventional photographic materials to cause various types of fog when incorporated into photothermographic materials, or for supersensitizers that are effective in photographic materials to be inactive in photothermographic materials.

These and other distinctions between photothermographic and photographic materials are described in *Unconventional Imaging Processes*, E. Brinckman et al. (Eds.), The Focal Press, London and New York, 1978, pp. 74-75, in D. H. Klosterboer, *Imaging Processes and Materials*, (*Neblette's Eighth Edition*), J. Sturge, V. Walworth, and A. Shepp, Eds., Van Nostrand-Reinhold, New York, 1989, Chapter 9, pp. 279-291, in C. Zou et al., *J. Imaging Sci. Technol.* 1996, 40, pp. 94-103, and in M. R. V. Sahyun, *J. Imaging Sci. Technol.* 1998, 42, 23.

Problem to be Solved:

Organic solvent-based photothermographic materials typically consist of a substrate, onto which is coated an imaging layer comprising a photothermographic emulsion in a polyvinyl butyral binder. A protective overcoat often is coated on top of the emulsion layer. These protective overcoats typically comprise predominately cellulose acetate butyrate (CAB) polymers. [See for example, U.S. Pat. No. 6,368,778 (Kong et al.)]. While adequate for some purposes, CAB is somewhat soft and its use can lead to sticking, scratching, and marring during feeding, imaging, and particularly during thermal development of thermally developable materials. Addition of a small amount of a polymethyl methacrylate provides good adhesion to the thermally developable emulsion layer, but the resultant overcoat is still soft, and sticking, scratching, and marring during various stages of imaging and development is still a problem.

U.S. Pat. No. 2,785,993 (Paist et al.) describes a trilayer construction of cellulose acetate, coated onto methyl vinyl ether/maleic anhydride copolymer, coated onto polyvinyl butyral, coated on an aluminum sheet. This construction is said to afford good adhesion of all of the layers and of the polyvinyl butyral to the aluminum. The constructions are said to be useful for printing plates and decorative articles. No mention is made of mixtures of vinyl ether/maleic anhydride copolymers with cellulose acetate. No photographic, thermographic, or photothermographic materials are in the polyvinyl butyral layer. The various layers are not coated simultaneously.

U.S. Pat. No. 4,741,992 (Przezdziecki) describes the use of poly(silicic acid) and water-soluble hydroxyl-containing polymers as an overcoat layer having good adhesion to polyvinyl butyral for use in thermally developable materials.

U.S. Pat. No. 5,804,365 (Bauer et al.) describes the addition of small amounts of organic non-ionic boron compounds to imaging layers containing polyvinyl acetal binders. Such addition is said to cross-link the binder and improve adhesion of polyvinyl alcohol overcoat layers.

U.S. Pat. No. 5,891,610 (Bauer et al.) describes the use of poly(silicic acid), a water-soluble hydroxyl-containing polymer, and a water-soluble polyvinyl acetal as a protective topcoat having good adhesion to polyvinyl butyral for use in thermally developable materials.

U.S. Pat. No. 5,928,857 (Geisler et al.) describes the addition of certain adhesion promoting resins to the emulsion layer to promote adhesion of the emulsion layer to the support.

Cellulose acetate (CA) has been used as the sole binder in protective overcoats for photothermographic materials. [See for example, U.S. Pat. No. 3,933,508 (Ohkubo et al.)]. Although cellulose acetate is harder and has a higher softening temperature than CAB, its use as protective overcoat for polyvinyl butyral based photothermographic materials creates a problem due to the poor adhesion of cellulose acetate to polyvinyl butyral. Addition of polymethyl methacrylate does not work in this construction, as polymethyl methacrylate does not promote the adhesion of cellulose acetate to polyvinyl butyral. The two materials are incompatible and produce hazy, non-uniform coatings.

U.S. Pat. No. 4,452,883 (Frenchik et al.) describes the use of mixtures of polyvinylpyrrolidine and methyl vinyl ether/maleic anhydride copolymer as barrier polymers for color photothermographic materials.

A need exists for improved protective overcoats for thermally developable materials that exhibit good adhesion to the photothermographic emulsion layer, are harder than the currently used overcoats, and have good optical clarity, with little if any effect on sensitometric properties.

SUMMARY OF THE INVENTION

This invention provides a thermally developable material that comprises a support having on at least one side thereon, one or more buried thermally developable imaging layers comprising a polyvinyl acetal binder, and in reactive association, a non-photosensitive source of reducible silver ions, and a reducing agent composition for the non-photosensitive source reducible silver ions, and having disposed over the one or more buried thermally developable imaging layers, an outermost overcoat layer comprising a mixture of a cellulose acetate polymer and one or more of an alkyl vinyl ether/maleic anhydride copolymer or an alkylethylene/maleic anhydride copolymer or mixtures thereof.

Typically, the thermally developable material is a silver halide containing photothermographic material and the outermost overcoat layer further comprises a surfactant.

The invention also provides a thermally developable material that comprises a support having on at least one side thereon, one or more buried thermally developable imaging layers comprising a polyvinyl acetal binder, and in reactive association, a non-photosensitive source of reducible silver ions, and a reducing agent composition for the non-photosensitive source reducible silver ions, and having disposed over the one or more buried thermally developable imaging layers, an outermost overcoat layer comprising a cellulose acetate polymer, and having an interlayer comprising an alkyl vinyl ether/maleic anhydride copolymer or an alkylethylene/maleic anhydride copolymer or mixtures thereof that is located between the thermally developable layer(s) and the outermost overcoat layer.

Typically, the thermally developable material is a silver halide containing photothermographic material and the outermost overcoat layer further comprises a surfactant.

The invention further provides a black-and-white, organic solvent-based photothermographic material that comprises a support having on an imaging side thereon, one or more buried photothermographic emulsion layers, comprising in reactive association: photosensitive grains of silver bromide or iodobromide that are sensitized to an exposure wavelength of at least 600 nm, one or more silver salts of aliphatic fatty acids including silver behenate, a reducing agent composition comprising a hindered phenol, a hindered bisphenol, a hindered trisphenol or a combination thereof, and a polyvinyl butyral binder, and an outermost overcoat layer disposed over the photothermographic emulsion layers, the outermost overcoat layer comprising a mixture of cellulose acetate polymer and methyl vinyl ether/maleic anhydride copolymer.

The invention still further provides a method of forming a visible image comprising: (A) imagewise exposing a thermally developable material of this invention that is a photothermographic material to electromagnetic radiation to form a latent image, (B) simultaneously or sequentially, heating the exposed photothermographic material to develop the latent image into a visible image.

In alternative methods of this invention, a method of forming a visible image comprises: (A') thermal imaging of the thermally developable material of this invention that is a thermographic material.

We have found that a mixture of an alkyl vinyl ether/maleic anhydride copolymer or an alkylethylene/maleic anhydride copolymer with cellulose acetate provides a protective overcoat for thermally developable materials. This protective overcoat exhibits good adhesion to the emulsion layer, is harder than previously used overcoats, has good optical clarity, and has little effect on the sensitometric properties of the thermally developable material.

DETAILED DESCRIPTION OF THE INVENTION

The thermally developable materials described herein are both thermographic and photothermographic materials. While the following discussion will often be directed primarily to the preferred photothermographic embodiments, it would be readily understood by one skilled in the art that thermographic materials can be similarly constructed and used to provide black-and-white images using appropriate imaging chemistry and particularly non-photosensitive organic silver salts, (photosensitive silver halides when used in photothermographic materials), reducing agents, toners, binders, and other components known to a skilled artisan. In both thermographic and photothermographic materials, the protective overcoats for the thermally developable materials described herein are coated over the thermographic or photothermographic emulsion layer.

The thermally developable materials of this invention can be used in black-and-white thermography and photothermography and in electronically generated black-and-white or color hardcopy recording. They can be used in microfilm applications, in radiographic imaging (for example digital medical imaging), X-ray radiography, and in industrial radiography. Furthermore, the absorbance of these materials between 350 and 450 nm is desirably low (less than 0.5), to permit their use in the graphic arts area (for example, imagesetting and phototypesetting), in the manufacture of printing plates, in contact printing, in duplicating ("duping"), and in proofing. Black-and-white imaging is particularly useful.

The thermally developable materials are particularly useful for imaging of human or animal subjects in response to X-radiation, ultraviolet, visible, or infrared radiation for use in a medical diagnosis. Such applications include, but are not limited to, thoracic imaging, mammography, dental imaging, orthopedic imaging, general medical radiography, therapeutic radiography, veterinary radiography, and autoradiography. When used with X-radiation, the photothermographic materials may be used in combination with one or more phosphor intensifying screens, with phosphors incorporated within the photothermographic emulsion, or with combinations thereof. Such materials are also useful for dental radiography when they are directly imaged by X-radiation. The materials are also useful for non-medical uses of X-radiation such as X-ray lithography and industrial radiography.

The photothermographic materials can be made sensitive to radiation of any suitable wavelength. Thus, in some embodiments, the materials are sensitive at ultraviolet, visible, infrared, or near infrared wavelengths, of the electromagnetic spectrum. In most embodiments, the materials are sensitive to radiation greater than 600 nm (for example, sensitive to infrared radiation from about 700 up to about 950 nm). Increased sensitivity to a particular region of the spectrum is imparted through the use of various spectral sensitizing dyes.

In the photothermographic materials, the components needed for imaging can be in one or more photothermographic imaging layers on one side ("frontside") of the support. The layer(s) that contain the photosensitive photocatalyst (such as a photosensitive silver halide) or non-photosensitive source of reducible silver ions, or both, are referred to herein as photothermographic emulsion layer(s). The photocatalyst and the non-photosensitive source of reducible silver ions are in catalytic proximity and generally are in the same emulsion layer. Similarly, in the thermographic materials, the components needed for imaging can be in one or more layers.

Where the photothermographic materials contain imaging layers on one side of the support only, various non-imaging layers are usually disposed on the "backside" (non-emulsion or non-imaging side) of the materials, including conductive/antistatic layers, antihalation layers, protective layers, and transport enabling layers.

Various non-imaging layers can also be disposed on the "frontside" or imaging or emulsion side of the support, including the frontside protective overcoat layers described herein, primer layers, interlayers, opacifying layers, conductive/antistatic layers, antihalation layers, acutance layers, auxiliary layers, and other layers readily apparent to one skilled in the art.

For some embodiments, it may be useful that the photothermographic materials be "double-sided" or "duplitized" and have the same or different photothermographic coatings (or imaging layers) on both sides of the support. In such constructions each side can also include one or more protective overcoat layers described herein, primer layers, interlayers, acutance layers, conductive/antistatic layers auxiliary layers, anti-crossover layers, and other layers readily apparent to one skilled in the art.

When the thermally developable materials are heat-developed as described below in a substantially water-free condition after, or simultaneously with, imagewise exposure, a silver image (for example, a black-and-white silver image) is obtained.

Definitions:

As used herein:

In the descriptions of the thermally developable materials, "a" or "an" component refers to "at least one" of that component.

As used herein, "black-and-white" refers to an image formed by silver metal, as opposed to an image formed using a combination of dyes or color couplers.

Unless otherwise indicated, when the terms "thermally developable materials," "photothermographic materials," and "thermographic materials" are used herein, the terms refer to materials of the present invention.

Heating in a substantially water-free condition as used herein, means heating at a temperature of from about 50° C. to about 250° C. with little more than ambient water vapor present. The term "substantially water-free condition" means that the reaction system is approximately in equilibrium with water in the air and water or any other solvent for inducing or promoting the reaction is not particularly or positively supplied from the exterior to the material. Such a condition is described in T. H. James, *The Theory of the Photographic Process*, Fourth Edition, Eastman Kodak Company, Rochester, N.Y., 1977, p. 374.

"Photothermographic material(s)" means a dry processable integral element comprising a support and at least one photothermographic emulsion layer or a photothermographic set of emulsion layers (wherein the photosensitive silver halide and the source of reducible silver ions are in one layer and the other necessary components or additives are distributed, as desired, in the same layer or in an adjacent coated layer). These materials also include multilayer constructions in which one or more imaging components are in different layers, but are in "reactive association". For example, one layer can include the non-photosensitive source of reducible silver ions and another layer can include the reducing agent, but the two reactive components are in reactive association with each other. By "integral", we mean that all imaging chemistry required for imaging is in the material without diffusion of imaging chemistry or reaction products (such as a dye) from or to another element (such as a receiver element).

"Thermographic materials" are similarly defined except that no photosensitive silver halide catalyst is purposely added or created.

When used in photothermography, the term, "imagewise exposing" or "imagewise exposure" means that the material is imaged as a dry processable material using any exposure means that provides a latent image using electromagnetic radiation. This includes, for example, by analog exposure where an image is formed by projection onto the photosensitive material as well as by digital exposure where the image is formed one pixel at a time such as by modulation of scanning laser radiation.

When used in thermography, the term, "imagewise exposing" or "imagewise exposure" means that the material is imaged using any means that provides an image using heat. This includes, for example, by analog exposure where an image is formed by differential contact heating through a mask using a thermal blanket or infrared heat source, as well as by digital exposure where the image is formed one pixel at a time such as by modulation of thermal print-heads or by thermal heating using scanning laser radiation.

"Emulsion layer," "imaging layer," "thermographic emulsion layer," or "photothermographic emulsion layer" means a layer of a thermographic or photothermographic material that contains the photosensitive silver halide (when used) and/or non-photosensitive source of reducible silver ions, or a reducing composition. Such layers can also contain additional components or desirable additives. These layers are on what is referred to as the "frontside" of the support.

"Photocatalyst" means a photosensitive compound such as silver halide that, upon exposure to radiation, provides a compound that is capable of acting as a catalyst for the subsequent development of the image-forming material.

"Catalytic proximity" or "reactive association" means that the reactive components are in the same layer or in adjacent layers so that they readily come into contact with each other during imaging and thermal development.

The terms "reducing agent" and "developer" mean the same, and the terms "co-reducing agent" and "co-developer" also mean the same.

"Simultaneous coating" or "wet-on-wet" coating means that when multiple layers are coated, subsequent layers are coated onto the initially coated layer before the initially coated layer is dry. Simultaneous coating can be used to apply layers on the frontside, backside, or both sides of the support.

"Transparent" means capable of transmitting visible light or imaging radiation without appreciable scattering or absorption.

The phrases "silver salt" and "organic silver salt" refer to an organic molecule having a bond to a silver atom. Although the compounds so formed are technically silver coordination complexes or silver compounds they are also often referred to as silver salts.

As used herein, the term "organic group" has its customary meaning and the term aliphatic organic group refers to straight or branched chain hydrocarbons such as alkanes, alkenes, or alkynes.

The term "aryl group" refers to an organic group derived from an aromatic hydrocarbon by removal of one atom, such as a phenyl group formed by removal of one hydrogen atom from benzene.

"Silver Efficiency" is defined as Dmax divided by the total silver coating weight in units of $g/m^2$.

The term "buried layer" means that there is at least one other layer disposed over the layer (such as a "buried" backside conductive layer).

The terms "coating weight", "coat weight", and "coverage" are synonymous, and are usually expressed in weight or moles per unit area such as $g/m^2$ or $mol/m^2$.

"Ultraviolet region of the spectrum" refers to that region of the spectrum less than or equal to 400 nm (for example, from about 100 nm to about 400 nm) although parts of these ranges may be visible to the naked human eye.

"Visible region of the spectrum" refers to that region of the spectrum of from about 400 nm to about 700 nm.

"Short wavelength visible region of the spectrum" refers to that region of the spectrum of from about 400 nm to about 450 nm.

"Red region of the spectrum" refers to that region of the spectrum of from about 600 nm to about 700 nm.

"Infrared region of the spectrum" refers to that region of the spectrum of from about 700 nm to about 1400 nm.

"Non-photosensitive" means not intentionally light sensitive.

The sensitometric terms "photospeed", "speed", or "photographic speed" (also known as sensitivity), absorbance, and contrast have conventional definitions known in the imaging arts. The sensitometric term absorbance is another term for optical density (OD).

Speed-3 is Log1/E+4 corresponding to the density value of 2.90 above Dmin where E is the exposure in ergs/$cm^2$.

Average Contrast-1 ("AC-1") is the absolute value of the slope of the line joining the density points at 0.60 and 2.00 above Dmin.

In photothermographic materials, the term Dmin (lower case) is considered herein as image density achieved when the photothermographic material is thermally developed without prior exposure to radiation. The term Dmax (lower case) is the maximum image density achieved in the imaged area of a particular sample after imaging and development. In thermographic materials, Dmin is considered herein as the image density in the areas with the minimum application of heat by the thermal print-head. In thermographic materials, the term Dmax is the maximum image density achieved when the thermographic material is thermally imaged with a given amount of thermal energy.

In both photothermographic and thermographic materials, the term DMIN (upper case) is the density of the non-imaged material. In photothermographic materials, the term DMAX (upper case) is the maximum image density achievable when the photothermographic material is exposed and then thermally developed. In thermographic materials, the term DMAX is the maximum image density achievable when the thermographic material is thermally developed. DMAX is also known as "Saturation Density".

As is well understood in this art, for the chemical compounds herein described, substitution is not only tolerated, but is often advisable and various substituents are anticipated on the compounds used in the present invention unless otherwise stated. Thus, when a compound is referred to as "having the structure" of a given formula or being a "derivative" of a compound, any substitution that does not alter the bond structure of the formula or the shown atoms within that structure is included within the formula, unless such substitution is specifically excluded by language.

Olefinic compounds that are described or shown with one particular geometry about the carbon-carbon double bond will be understood to include both "cis" and "trans" isomers about the double bond, including mixtures thereof unless otherwise specified or required by the specific arrangement of atoms.

As a means of simplifying the discussion and recitation of certain substituent groups, the term "group" refers to chemical species that may be substituted as well as those that are not so substituted. Thus, the term "alkyl group" is intended to include not only pure hydrocarbon alkyl chains, such as methyl, ethyl, n-propyl, t-butyl, cyclohexyl, iso-octyl, and octadecyl, but also alkyl chains bearing substituents known in the art, such as hydroxyl, alkoxy, phenyl, halogen atoms (F, Cl, Br, and I), cyano, nitro, amino, and carboxy. For example, alkyl group includes ether and thioether groups (for example $CH_3$—$CH_2$—$CH_2$—O—$CH_2$— and $CH_3$—$CH_2$—$CH_2$—S—$CH_2$—), haloalkyl, nitroalkyl, alkylcarboxy, carboxyalkyl, carboxamido, hydroxyalkyl, sulfoalkyl, and other groups readily apparent to one skilled in the art. Substituents that adversely react with other active ingredients, such as very strongly electrophilic or oxidizing substituents, would, of course, be excluded by the skilled artisan as not being inert or harmless.

*Research Disclosure* (http://www.researchdisclosure.com) is a publication of Kenneth Mason Publications Ltd., The Book Barn, Westbourne, Hampshire PO10 8RS, UK. It is also available from Emsworth Design Inc., 200 Park Avenue South, Room 1101, New York, N.Y. 10003.

Other aspects, advantages, and benefits of the present invention are apparent from the detailed description, examples, and claims provided in this application.

The Photocatalyst:

As noted above, photothermographic materials include one or more photocatalysts in the photothermographic emulsion layer(s). Useful photocatalysts are typically photosensitive silver halides such as silver bromide, silver iodide, silver chloride, silver bromoiodide, silver chlorobromoiodide, silver chlorobromide, and others readily apparent to one skilled in the art. Mixtures of silver halides can also be used in any suitable proportion. Silver bromide and silver iodide are useful. Also useful is silver bromoiodide in which any suitable amount of iodide is present up to almost 100% silver iodide and more likely up to about 40 mol % silver iodide. For example, the silver bromoiodide can comprise at least 70 mole % (for example, at least 85 mole % and or at least 90 mole %) bromide (based on total silver halide). The remainder of the halide is iodide, chloride, or chloride and iodide. In most embodiments, the additional halide is iodide. Silver bromide and silver bromoiodide are most useful, with the latter silver halide generally having up to 10 mole % silver iodide.

The silver halide grains may have any crystalline habit or morphology including, but not limited to, cubic, octahedral, tetrahedral, orthorhombic, rhombic, dodecahedral, other polyhedral, tabular, laminar, twinned, or platelet morphologies and may have epitaxial growth of crystals thereon. If desired, a mixture of grains with different morphologies can be employed. Silver halide grains having cubic and tabular morphology (or both) are useful.

The silver halide grains may have a uniform ratio of halide throughout. They may also have a graded halide content, with a continuously varying ratio of, for example, silver bromide and silver iodide or they may be of the core-shell type, having a discrete core of one or more silver halides, and a discrete shell of one or more different silver halides. Core-shell silver halide grains useful in photothermographic materials and methods of preparing these materials are described in U.S. Pat. No. 5,382,504 (Shor et al.). Iridium and/or copper doped core-shell and non-core-shell grains are described in U.S. Pat. No. 5,434,043 (Zou et al.) and U.S. Pat. No. 5,939,249 (Zou). Bismuth(III)-doped high silver iodide emulsions for photothermographic materials are described in U.S. Pat. No. 6,942,960 (Maskasky et al.).

In some instances, it may be helpful to prepare the photosensitive silver halide grains in the presence of a hydroxytetraazaindene (such as 4-hydroxy-6-methyl-1,3,3a,7-tetraazaindene) or an N-heterocyclic compound comprising at least one mercapto group (such as 1-phenyl-5-mercaptotetrazole) as described in U.S. Pat. No. 6,413,710 (Shor et al.).

The photosensitive silver halide can be added to (or formed within) the emulsion layer(s) in any fashion as long as it is placed in catalytic proximity to the non-photosensitive source of reducible silver ions.

In many embodiments, the silver halides are preformed and prepared by an ex-situ process. With this technique, one has the possibility of more precisely controlling the grain size, grain size distribution, dopant levels, and composition of the silver halide, so that one can impart more specific properties to both the silver halide grains and the resulting photothermographic material.

In some constructions, it is desired to form the non-photosensitive source of reducible silver ions in the presence of ex-situ-prepared silver halide. In this process, the source of reducible silver ions, such as a long chain fatty acid silver carboxylate (commonly referred to as a silver "soap" or homogenate), is formed in the presence of the preformed silver halide grains. Co-precipitation of the source of reducible silver ions in the presence of silver halide provides a more intimate mixture of the two materials to provide a material often referred to as a "preformed soap" [see U.S. Pat. No. 3,839,049 (Simons)].

In other constructions, the preformed silver halide grains may be added to and "physically mixed" with the non-photosensitive source of reducible silver ions.

Preformed silver halide emulsions can be prepared by aqueous or organic processes and can be unwashed or washed to remove soluble salts. Soluble salts can be removed by any desired procedure for example as described in U.S. Pat. No. 2,489,341 (Waller et al.), U.S. Pat. No. 2,565,418 (Yackel), U.S. Pat. No. 2,614,928 (Yutzy et al.), U.S. Pat. No. 2,618,556 (Hewitson et al.), and U.S. Pat. No. 3,241,969 (Hart et al.).

It is also effective to use an in-situ process in which a halide- or a halogen-containing compound is added to an organic silver salt to partially convert the silver of the organic silver salt to silver halide. Inorganic halides (such as zinc bromide, zinc iodide, calcium bromide, lithium bromide, lithium iodide, or mixtures thereof) or an organic halogen-containing compound (such as N-bromo-succinimide or pyridinium hydrobromide perbromide) can be used. The details of such in-situ generation of silver halide are described in U.S. Pat. No. 3,457,075 (Morgan et al.).

It is particularly effective to use a mixture of both preformed and in-situ generated silver halide. The preformed silver halide is typically present in a preformed soap.

Additional methods of preparing silver halides and organic silver salts and blending them are described in *Research Disclosure*, June 1978, item 17029, U.S. Pat. No. 3,700,458 (Lindholm) and U.S. Pat. No. 4,076,539 (Ikenoue et al.), and Japan Kokai 49-013224 (Fuji), 50-017216 (Fuji), and 51-042529 (Fuji).

The silver halide grains used in the imaging formulations can vary in average diameter of up to several micrometers (μm) depending on the desired use. For example, silver halide grains for use in preformed emulsions containing silver carboxylates are cubic grains having a number average particle size of from about 0.01 to about 1.0 μm, or typically those having a number average particle size of from about 0.03 to about 0.1 μm. The grains may have a number average particle size of 0.06 μm or less, and typically they have a number average particle size of from about 0.03 to about 0.06 μm. Mixtures of grains of various average particle size can also be used. Silver halide grains for use in high-speed photothermographic constructions are tabular grains having an average thickness of at least 0.02 μm and up to and including 0.10 μm, an equivalent circular diameter of at least 0.5 μm and up to and including 8 μm and an aspect ratio of at least 5:1. Other grains have an average thickness of at least 0.03 μm and up to and including 0.08 μm, an equivalent circular diameter of at least 0.75 μm and up to and including 6 μm and an aspect ratio of at least 10:1.

The average size of the photosensitive silver halide grains is expressed by the average diameter if the grains are spherical, and by the average of the diameters of equivalent circles for the projected images if the grains are cubic or in other non-spherical shapes. Representative grain sizing methods are described in *Particle Size Analysis*, ASTM Symposium on Light Microscopy, R. P. Loveland, 1955, pp. 94-122, and in C. E. K. Mees and T. H. James, *The Theory of the Photographic Process*, Third Edition, Macmillan, New York, 1966, Chapter 2. Particle size measurements may be expressed in terms of the projected areas of grains or approximations of their diameters. These will provide reasonably accurate results if the grains of interest are substantially uniform in shape.

The one or more light-sensitive silver halides are generally present in an amount of from about 0.005 to about 0.5 mole, typically from about 0.01 to about 0.25 mole, or from about 0.03 to about 0.15 mole, per mole of non-photosensitive source of reducible silver ions.

Chemical Sensitization:

The photosensitive silver halides can be chemically sensitized using any useful compound that contains sulfur, tellurium, or selenium, or may comprise a compound containing gold, platinum, palladium, ruthenium, rhodium, iridium, or combinations thereof, a reducing agent such as a tin halide or a combination of any of these. The details of these materials are provided for example, in T. H. James, *The Theory of the Photographic Process*, Fourth Edition, Eastman Kodak Company, Rochester, N.Y., 1977, Chapter 5, pp. 149-169. Suitable conventional chemical sensitization procedures are also described in U.S. Pat. No. 1,623,499 (Sheppard et al.), U.S. Pat. No. 2,399,083 (Waller et al.), U.S. Pat. No. 3,297,446 (Dunn), U.S. Pat. No. 3,297,447 (McVeigh), U.S. Pat. No. 5,049,485 (Deaton), U.S. Pat. No. 5,252,455 (Deaton), U.S. Pat. No. 5,391,727 (Deaton), U.S. Pat. No. 5,759,761 (Lushington et al.), and U.S. Pat. No. 5,912,111 (Lok et al.), and EP 0 915 371 A1 (Lok et al.).

Mercaptotetrazoles and tetraazindenes as described in U.S. Pat. No. 5,691,127 (Daubendiek et al.) can also be used as suitable addenda for tabular silver halide grains.

Certain substituted and unsubstituted thiourea compounds can be used as chemical sensitizers including those described in U.S. Pat. No. 6,368,779 (Lynch et al.).

Still other additional chemical sensitizers include certain tellurium-containing compounds that are described in U.S. Pat. No. 6,699,647 (Lynch et al.), and certain selenium-containing compounds that are described in U.S. Pat. No. 6,620,577 (Lynch et al.).

Combinations of gold(III)-containing compounds and either sulfur-, tellurium-, or selenium-containing compounds are also useful as chemical sensitizers as described in U.S. Pat. No. 6,423,481 (Simpson et al.).

In addition, sulfur-containing compounds can be decomposed on silver halide grains in an oxidizing environment according to the teaching in U.S. Pat. No. 5,891,615 (Winslow et al.). Examples of sulfur-containing compounds that can be used in this fashion include sulfur-containing spectral sensitizing dyes. Other useful sulfur-containing chemical sensitizing compounds that can be decomposed in an oxidizing environment are the diphenylphosphine sulfide compounds described in U.S. Pat. No. 7,026,105 (Simpson et al.), U.S. Pat. No. 7,063,941 (Burleva et al.), and U.S. Pat. No. 7,087,366 (Burleva et al.).

The chemical sensitizers can be present in conventional amounts that generally depend upon the average size of the silver halide grains. Generally, the total amount is at least $10^{-10}$ mole per mole of total silver, and typically from about $10^{-8}$ to about $10^{-2}$ mole per mole of total silver for silver halide grains having an average size of from about 0.01 to about 1 μm.

Spectral Sensitization:

The photosensitive silver halides may be spectrally sensitized with one or more spectral sensitizing dyes that are known to enhance silver halide sensitivity to ultraviolet, visible, and/or infrared radiation (that is, sensitivity within the range of from about 300 to about 1400 nm). In most embodiments the photosensitive silver halide is sensitized to infrared radiation (that is from about 700 to about 950 nm). Non-limiting examples of spectral sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. They may be added at any stage in the preparation of the photothermographic emulsion, but are generally added after chemical sensitization is achieved.

Suitable spectral sensitizing dyes such as those described in U.S. Pat. No. 3,719,495 (Lea), U.S. Pat. No. 4,396,712 (Kinoshita et al.), U.S. Pat. No. 4,439,520 (Kofron et al.), U.S. Pat. No. 4,690,883 (Kubodera et al.), U.S. Pat. No. 4,840,882 (Iwagaki et al.), U.S. Pat. No. 5,064,753 (Kohno et al.), U.S. Pat. No. 5,281,515 (Delprato et al.), U.S. Pat. No. 5,393,654 (Burrows et al.), U.S. Pat. No. 5,441,866 (Miller et al.), U.S. Pat. No. 5,508,162 (Dankosh), U.S. Pat. No. 5,510,236 (Dankosh), and U.S. Pat. No. 5,541,054 (Miller et al.), Japan Kokai 2000-063690 (Tanaka et al.), 2000-112054 (Fukusaka et al.), 2000-273329 (Tanaka et al.), 2001-005145 (Arai), 2001-064527 (Oshiyama et al.), and 2001-154305 (Kita et al.) can be used. Useful spectral sensitizing dyes are also described in *Research Disclosure*, December 1989, item 308119, Section IV and *Research Disclosure*, 1994, item 36544, section V.

Teachings relating to specific combinations of spectral sensitizing dyes also include U.S. Pat. No. 4,581,329 (Sugimoto et al.), U.S. Pat. No. 4,582,786 (Ikeda et al.), U.S. Pat. No. 4,609,621 (Sugimoto et al.), U.S. Pat. No. 4,675,279 (Shuto et al.), U.S. Pat. No. 4,678,741 (Yamada et al.), U.S. Pat. No. 4,720,451 (Shuto et al.), U.S. Pat. No. 4,818,675 (Miyasaka et al.), U.S. Pat. No. 4,945,036 (Arai et al.), and U.S. Pat. No. 4,952,491 (Nishikawa et al.).

Also useful are spectral sensitizing dyes that decolorize by the action of light or heat as described in U.S. Pat. No. 4,524,128 (Edwards et al.) and Japan Kokai 2001-109101 (Adachi), 2001-154305 (Kita et al.), and 2001-183770 (Hanyu et al.).

Dyes and other compounds may be selected for the purpose of supersensitization to attain much higher sensitivity than the sum of sensitivities that can be achieved by using a sensitizer alone. Examples of such supersensitizers include the metal chelating compounds disclosed in U.S. Pat. No. 4,873,184 (Simpson), the large cyclic compounds featuring a heteroatom disclosed in U.S. Pat. No. 6,475,710 (Kudo et al.), and the stilbene compounds disclosed in EP 0 821 271 (Uytterhoeven et al.).

An appropriate amount of spectral sensitizing dye added is generally about $10^{-10}$ to $10^{-1}$ mole, and typically, about $10^{-7}$ to $10^{-2}$ mole per mole of silver halide.

Non-Photosensitive Source of Reducible Silver Ions:

The non-photosensitive source of reducible silver ions in the thermally developable materials is a silver-organic compound that contains reducible silver(I) ions. Such compounds are generally silver salts of silver organic coordinating ligands that are comparatively stable to light and form a silver image when heated to 50° C. or higher in the presence of an exposed photocatalyst (such as silver halide) and a reducing agent composition.

Organic silver salts that are particularly useful in organic solvent-based thermographic and photothermographic materials also include silver carboxylates (both aliphatic and aryl carboxylates), silver salts of benzotriazoles, silver sulfonates, silver sulfosuccinates, and silver acetylides.

The primary organic silver salt is often a silver salt of an aliphatic carboxylic acid (described below). Mixtures of silver salts of aliphatic carboxylic acids are particularly useful where the mixture includes at least silver behenate. The carboxylic acids from which these silver salts are prepared are also often referred to as "fatty carboxylic acids" or "long chain fatty carboxylic acids", or long chain carboxylates.

Useful silver carboxylates include silver salts of long-chain aliphatic carboxylic acids. The aliphatic carboxylic acids generally have aliphatic chains that contain 10 to 30, and typically contain 15 to 28, carbon atoms. Examples of such silver salts include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof. For example, at least silver behenate is used alone or in mixtures with other silver carboxylates. These silver salts are often referred to as "silver salts of fatty carboxylic acids", "silver salts of long chain carboxylic acids", or more simply as "silver carboxylates". Dispersions of these materials are known as "silver carboxylate soaps" "silver soaps", or "silver soaps of long chain carboxylic acids".

It is also convenient to use silver half soaps such as an equimolar blend of silver carboxylate and carboxylic acid that analyzes for about 14.5% by weight solids of silver in the blend and that is prepared by precipitation from an aqueous solution of an ammonium or an alkali metal salt of a commercially available fatty carboxylic acid, or by addition of the free fatty acid to the silver soap.

Silver salts other than the silver carboxylates described above can be used also. Such silver salts include silver salts of aliphatic carboxylic acids containing a thioether group as described in U.S. Pat. No. 3,330,663 (Weyde et al.), soluble silver carboxylates comprising hydrocarbon chains incorporating ether or thioether linkages or sterically hindered substitution in the α-(on a hydrocarbon group) or ortho-(on an phenyl group) position as described in U.S. Pat. No. 5,491,059 (Whitcomb), silver salts of dicarboxylic acids, silver salts of sulfonates as described in U.S. Pat. No. 4,504,575 (Lee), silver salts of sulfosuccinates as described in EP 0 227 141 A1 (Leenders et al.), silver salts of aryl carboxylic acids (such as silver benzoate), silver salts of acetylenes as described, for example in U.S. Pat. No. 4,761,361 (Ozaki et al.) and U.S. Pat. No. 4,775,613 (Hirai et al.), and silver salts of heterocyclic compounds containing mercapto or thione groups and derivatives as described in U.S. Pat. No. 4,123,274 (Knight et al.) and U.S. Pat. No. 3,785,830 (Sullivan et al.).

The methods used for making silver soap emulsions are well known in the art and are disclosed in *Research Disclosure*, April 1983, item 22812, *Research Disclosure*, October 1983, item 23419, U.S. Pat. No. 3,985,565 (Gabrielsen et al.) and the references cited above.

Sources of non-photosensitive reducible silver ions can also be core-shell silver salts as described in U.S. Pat. No. 6,355,408 (Whitcomb et al.), silver dimer compounds that comprise two different silver salts as described in U.S. Pat. No. 6,472,131 (Whitcomb), or the silver core-shell compounds comprising a primary core comprising one or more photosensitive silver halides, or one or more non-photosensitive inorganic metal salts or non-silver containing organic salts, and a shell at least partially covering the primary core, wherein the shell comprises one or more non-photosensitive silver salts, each of which silver salts comprises a organic silver coordinating ligand, as described in U.S. Pat. No. 6,803,177 (Bokhonov et al.). The source of non-photosensitive reducible silver can also be prepared by silver ion exchange with core-shell compounds made up of different inorganic long-chain carboxylate salts as described U.S. Pat. No. 7,524,621 (Burleva et al.).

Useful nitrogen-containing organic silver salts and methods of preparing them are described in U.S. Pat. No. 6,977,139 (Hasberg et al.). Such silver salts (particularly the silver benzotriazoles) are rod-like in shape and have an average aspect ratio of at least 3:1 and a width index for particle diameter of 1.25 or less. Silver salt particle length is generally less than 1 μm. Also useful are silver salt-toner co-precipitated nano-crystals that comprise a silver salt of a nitrogen-containing heterocyclic compound containing an imino group, and a silver salt comprising a silver salt of a mercaptotriazole. Such co-precipitated salts are described in U.S Pat. No. 7,008,748 (Hasberg et al.).

The one or more non-photosensitive sources of reducible silver ions are generally present in an amount of from about 5% to about 70%, and typically from about 10% to about 50%, based on the total dry weight of the emulsion layers. Alternatively stated, the amount of the sources of reducible silver ions is generally from about 0.002 to about 0.2 mol/$m^2$ of the dry photothermographic material (typically from about 0.01 to about 0.05 mol/$m^2$).

The total amount of silver (from all silver sources) in the photothermographic materials is generally at least 0.002 mol/$m^2$, typically from about 0.01 to about 0.05 mol/$m^2$, or from about 0.01 to about 0.02 mol/$m^2$. In other aspects, it is desirable to use total silver [from both silver halide (when present) and reducible silver salts] at a coating weight generally of less than 2.6 g/$m^2$, typically at least 1 but less than about 2.0 g/$m^2$, or equal to or less than 1.9 g/$m^2$.

Reducing Agent:

The reducing agent (or reducing agent composition comprising two or more components) for the source of reducible silver ions can be any material (generally an organic material) that can reduce silver (1+) ion to metallic silver. The "reducing agent" is sometimes called a "developer" or "developing agent".

When a silver carboxylate silver source is used in a photothermographic material, one or more hindered phenol, hindered bis-phenol, or hindered tris-phenol reducing agents are typically used. Combinations of all three classes are also often useful. In some instances, the reducing agent composition comprises two or more components such as a hindered phenol or hindered bis-phenol, or hindered tris-phenol developer and a co-developer that can be chosen from the various classes of co-developers described below. Ternary mixtures involving the further addition of contrast enhancing agents are also useful. Such contrast enhancing agents can be chosen from the various classes of contrast enhancing agents described below.

"Hindered phenol reducing agents" are compounds that contain only one hydroxyl group on a given phenyl ring and have at least one additional substituent located ortho to the hydroxyl group.

One type of hindered phenol reducing agents is hindered phenols and hindered naphthols. This type of hindered phenol includes, for example, 2,6-di-t-butyl-4-methylphenol, 2,6-di-t-butyl-4-benzylphenol, 2-benzyl-4-methyl-6-t-butylphenol, 2,4-dimethyl-6-(1'-methylcyclohexyl)phenol, and 3,5-bis(1,1-dimethylethyl)-4-hydroxy-benzenepropanoic acid 2,2-bis[[3-[3,5-bis(1,1-dimethylethyl)-4-hydroxyphenyl]-1-oxo-propoxy]methyl]-1,3-propanediyl ester (IRGANOX® 1010).

Another type of hindered phenol reducing agent includes hindered bis-phenols. "Hindered bis-phenols" contain more than one hydroxyl group each of which is located on a different phenyl ring. This type of hindered phenol includes, for example, binaphthols (that is dihydroxybinaphthyls), biphenols (that is dihydroxybiphenyls), bis(hydroxynaphthyl) methanes, bis(hydroxyphenyl)-methanes, bis(hydroxyphenyl)ethers, bis(hydroxyphenyl)sulfones, and bis (hydroxyphenyl)thioethers, each of which may have additional substituents.

Particularly useful hindered bis-phenol reducing agents are bis(hydroxyphenyl)methanes such as, bis(2-hydroxy-3-t-butyl-5-methyl-phenyl)methane, 1,1'-bis(2-hydroxy-3,5-dimethylphenyl)-3,5,5-trimethylhexane, bis[2-hydroxy-3-(1-methylcyclohexyl)-5-methylphenyl)methane, 2,6-bis[(2-hydroxy-3,5-dimethylphenyl)methyl]-4-methylphenol, 1,1'-bis(2-hydroxy-3,5-dimethylphenyl)isobutane, and 2,6-bis[(2-hydroxy-3,5-dimethylphenyl)methyl]-4-methylphenol. Such hindered bis-phenol compounds also have at least one non-hydrogen substituent ortho to the hydroxyl group and are often referred to as "hindered ortho-bis-phenols".

Additional useful reducing agents include bis-phenols having non-aromatic cyclic groups attached to the linking methylene group as described for example, in U.S. Pat. No. 6,699,649 (Nishijima et al.), bis-phenols having cycloaliphatic or alkylene groups attached to the linking methylene group as described for example in U.S. Pat. No. 7,192,695 (Sakai et al.), and bis-phenols having secondary or tertiary substituents on the phenol rings as described for example, in U.S. Pat. No. 6,485,898 (Yoshioka et al.).

In some embodiments, useful reducing agents are bis-phenol developers incorporating bicyclic and tricyclic substituents ortho to the hydroxyl group on the aromatic rings (ortho-bicyclic or tricyclic substituted bis-phenol developers). Such reducing agents are described in U.S. Pat. No. 7,241,561 (Lynch et al.). Also useful are the mixture of phenolic reducing agents described in U.S. Patent Application Publication 2008/0057450 (Ulrich et al.). Additionally useful are the combinations of tris-phenol reducing agents and substituted olefinic co-developers as described in U.S. Patent Application Publications 2008/0145801 (Zou et al.) and 2008/0145800 (Zou et al.). Additionally useful are the tris-phenol reducing agents represented by Structure (III) in U.S. Pat. No. 7,468,241 (Lynch et al.). All of the above patent documents are incorporated herein by reference.

Mixtures of hindered phenol reducing agents can be used if desired, such as the mixture of a hindered phenol and a hindered bis-phenol described in U.S. Pat. No. 6,413,712 (Yoshioka et al.) and U.S. Pat. No. 6,645,714 (Oya et al.). Mixtures of hindered phenol, hindered bis-phenol, and hindered tris-phenol reducing agents may be used.

Still other optional reducing agents include the bis-phenol-phosphorous compounds described in U.S. Pat. No. 6,514,684 (Suzuki et al), the bis-phenol, aromatic carboxylic acid, hydrogen bonding compound mixture described in U.S. Pat. No. 6,787,298 (Yoshioka), and the compounds that can be one-electron oxidized to provide a one-electron oxidation product that releases one or more electrons as described in U.S. Pat. No. 7,303,864 (Ohzeki). Still other useful reducing agents are described in U.S. Pat. No. 3,074,809 (Owen), U.S.

Pat. No. 3,080,254 (Grant, Jr.), U.S. Pat. No. 3,094,417 (Workman), U.S. Pat. No. 3,887,417 (Klein et al.), U.S. Pat. No. 4,030,931 (Noguchi et al.), and U.S. Pat. No. 5,981,151 (Leenders et al.).

Additional reducing agents that may be used include amidoximes, azines, a combination of aliphatic carboxylic acid aryl hydrazides and ascorbic acid, a reductone and/or a hydrazine, piperidinohexose reductone or formyl-4-methylphenylhydrazine, hydroxamic acids, a combination of azines and sulfonamidophenols, α-cyanophenylacetic acid derivatives, reductones, indane-1,3-diones, chromans, 1,4-dihydropyridines, and 3-pyrazolidones.

The reducing agent (or mixture thereof) described herein is generally present at from about 1 to about 25% (dry weight) of the photothermographic emulsion layer in which it is located. In multilayer constructions, if the reducing agent is added to a layer other than a photothermographic emulsion layer, slightly higher proportions, of from about 2 to 35 weight % may be more desirable. Thus, the total range for the reducing agent is from about 1 to about 35% (dry weight). Also, the reducing agent (or mixture thereof) described herein is generally present in an amount of at least 0.1 and up to and including 0.5 mol/mol of total silver in the photothermographic material, and typically in an amount of from about 0.1 to about 0.4 mol/mol of total silver.

Other Addenda:

The photothermographic materials can also contain other additives such as contrast enhancing agents, shelf-life stabilizers, antifoggants, toners, development accelerators, acutance dyes, post-processing stabilizers or stabilizer precursors, thermal solvents (also known as melt formers), antistatic or conductive layers, and other image-modifying agents as would be readily apparent to one skilled in the art.

Various contrast enhancing agents can be added. Such materials are useful for preparing printing plates and duplicating films useful in graphic arts, or for nucleation of medical diagnostic films. Examples of such contrast enhancing agents are described in U.S. Pat. No. 6,150,084 (Ito et al.), U.S. Pat. No. 6,620,582 (Hirabayashi), and U.S. Pat. No. 6,764,385 (Watanabe et al.). Certain contrast enhancing agents are generally used in some photothermographic materials with specific co-reducing agents. Examples of useful contrast enhancing agents include, but are not limited to, hydroxylamines, alkanolamines and ammonium phthalamate compounds as described in U.S. Pat. No. 5,545,505 (Simpson), hydroxamic acid compounds as described for example, in U.S. Pat. No. 5,545,507 (Simpson et al.), N-acylhydrazine compounds as described in U.S. Pat. No. 5,558,983 (Simpson et al.), and hydrogen atom donor compounds as described in U.S. Pat. No. 5,637,449 (Harring et al.).

Suitable stabilizers that can be used alone or in combination include thiazolium salts as described in U.S. Pat. No. 2,131,038 (Brooker) and U.S. Pat. No. 2,694,716 (Allen), azaindenes as described in U.S. Pat. No. 2,886,437 (Piper), triazaindolizines as described in U.S. Pat. No. 2,444,605 (Heimbach), the urazoles described in U.S. Pat. No. 3,287,135 (Anderson), sulfocatechols as described in U.S. Pat. No. 3,235,652 (Kennard), the oximes described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum, and gold salts as described in U.S. Pat. No. 2,566,263 (Trirelli) and U.S. Pat. No. 2,597,915 (Damshroder), and the heteroaromatic mercapto compounds or heteroaromatic disulfide compounds described in EP 0 559 228 B1 (Philip et al.).

Heteroaromatic mercapto compounds are useful including 2-mercaptobenzimidazole, 2-mercapto-5-methylbenzimidazole, 2-mercaptobenzo-thiazole and 2-mercaptobenzoxazole, and mixtures thereof. A heteroaromatic mercapto compound is generally present in an emulsion layer in an amount of at least 0.0001 mole (typically from about 0.001 to about 1.0 mole) per mole of total silver in the emulsion layer.

Other useful antifoggants/stabilizers are described in U.S. Pat. No. 6,083,681 (Lynch et al.). Still other antifoggants are hydrobromic acid salts of heterocyclic compounds (such as pyridinium hydrobromide perbromide) as described in U.S. Pat. No. 5,028,523 (Skoug), benzoyl acid compounds as described in U.S. Pat. No. 4,784,939 (Pham), substituted propenenitrile compounds as described in U.S. Pat. No. 5,686,228 (Murray et al.), silyl blocked compounds as described in U.S. Pat. No. 5,358,843 (Sakizadeh et al.), the 1,3-diaryl-substituted urea compounds described in U.S. Pat. No. 7,261,999 (Hunt et al.), and tribromo-methylketones as described in EP 0 600 587 A1 (Oliff et al.).

Additives useful as stabilizers for improving dark stability and desktop print stability are the various boron compounds described in U.S. Patent Application Publication 2006/0141404 (Philip et al.). The boron compounds can be added in an amount of from about 0.010 to about 0.50 g/m$^2$.

Additives useful for providing materials with imaging properties that are little changed with changes in humidity are the crown ether-alkali metal complex cation of an enolate anion of an aldehyde having at least one electron withdrawing group in the alpha (α) position that are described in U.S. Pat. No. 7,267,935 (Simpson et al.) that is incorporated herein by reference.

Also useful as stabilizers for improving the post-processing print stability of the imaged material to heat during storage (known as "hot-dark print stability") are arylboronic acid compounds as described in U.S. Pat. No. 7,255,982 (Chen-Ho, et al.) and sulfonyldiphenols as described in U.S. Pat. No. 7,258,967 (Sakizadeh, et al.), both incorporated herein by reference.

The photothermographic materials may also include one or more polyhalogen stabilizers that can be represented by the formula Q-(Y)$_n$—C($Z_1Z_2X$) wherein, Q represents an alkyl, aryl (including heteroaryl) or heterocyclic group, Y represents a divalent linking group, n represents 0 or 1, $Z_1$ and $Z_2$ each represents a halogen atom, and X represents a hydrogen atom, a halogen atom, or an electron-withdrawing group. Particularly useful compounds of this type are polyhalogen stabilizers wherein Q represents an aryl group, Y represents (C═O) or $SO_2$, n is 1, and $Z_1$, $Z_2$, and X each represent a bromine atom. Examples of such compounds containing —$SO_2CBr_3$ groups are described in U.S. Pat. No. 3,874,946 (Costa et al.), U.S. Pat. No. 5,369,000 (Sakizadeh et al.), U.S. Pat. No. 5,374,514 (Kirk et al.), U.S. Pat. No. 5,460,938 (Kirk et al.), U.S. Pat. No. 5,464,747 (Sakizadeh et al.) and U.S. Pat. No. 5,594,143 (Kirk et al.). Examples of such compounds include, but are not limited to, 2-tribromomethylsulfonyl-5-methyl-1,3,4-thiadiazole, 2-tribromomethylsulfonylpyridine, 2-tribromomethylsulfonylquinoline, and 2-tribromomethylsulfonylbenzene. The polyhalogen stabilizers can be present in one or more layers in a total amount of from about 0.005 to about 0.01 mol/mol of total silver, and typically from about 0.01 to about 0.05 mol/mol of total silver.

Stabilizer precursor compounds capable of releasing stabilizers upon application of heat during imaging can also be used, as described in U.S. Pat. No. 5,158,866 (Simpson et al.), U.S. Pat. No. 5,175,081 (Krepski et al.), U.S. Pat. No. 5,298,390 (Sakizadeh et al.), and U.S. Pat. No. 5,300,420 (Kenney et al.). Also useful are the blocked aliphatic thiol compounds described in U.S. Pat. No. 7,169,543 (Ramsden et al.).

In addition, certain substituted sulfonyl derivatives of benzotriazoles may be used as stabilizing compounds as described in U.S. Pat. No. 6,171,767 (Kong et al.).

"Toners" or derivatives thereof that improve the image are desirable components of the photothermographic materials. These compounds, when added to the imaging layer, shift the color of the image from yellowish-orange to brown-black or blue-black. Generally, one or more toners described herein are present in an amount of from about 0.01% to about 10% (more typically from about 0.1 % to about 10%), based on the total dry weight of the layer in which the toner is included. Toners may be incorporated in the photothermographic emulsion or in an adjacent non-imaging layer.

Compounds useful as toners are described in U.S. Pat. No. 3,080,254 (Grant, Jr.), U.S. Pat. No. 3,847,612 (Winslow), U.S. Pat. No. 4,123,282 (Winslow), U.S. Pat. No. 4,082,901 (Laridon et al.), U.S. Pat. No. 3,074,809 (Owen), U.S. Pat. No. 3,446,648 (Workman), U.S. Pat. No. 3,844,797 (Willems et al.), U.S. Pat. No. 3,951,660 (Hagemann et al.), U.S. Pat. No. 5,599,647 (Defieuw et al.) and GB 1,439,478 (AGFA).

Additional useful toners are substituted and unsubstituted mercaptotriazoles as described in U.S. Pat. No. 3,832,186 (Masuda et al.), U.S. Pat. No. 6,165,704 (Miyake et al.), U.S. Pat. No. 5,149,620 (Simpson et al.), U.S. Pat. No. 6,713,240 (Lynch et al.), and U.S. Pat. No. 6,841,343 (Lynch et al.).

Phthalazine and phthalazine derivatives [such as those described in U.S. Pat. No. 6,146,822 (Asanuma et al.)], phthalazinone, and phthalazinone derivatives are particularly useful toners.

Useful phthalazinone compounds are those having sufficient solubility to completely dissolve in the formulation from which they are coated. Representative phthalazinone compounds include 6,7-dimethoxy-1-(2H)-phthalazinone, 4-(4-pentylphenyl)-1-(2H)-phthalazinone, and 4-(4-cyclohexylphenyl)-1-(2H)-phthalazinone. Mixtures of such phthalazinone compounds can be used if desired.

The addition of development accelerators that increase the rate of image development and allow reduction in silver coating weight is also useful. Suitable development accelerators include phenols, naphthols, and hydrazinecarboxamides. Such compounds are described, for example, in Y. Yoshioka, K. Yamane, T. Ohzeki, *Development of Rapid Dry Photothermographic Materials with Water-Base Emulsion Coating Method*, AgX 2004: The International Symposium on Silver Halide Technology "At the Forefront of Silver Halide Imaging", Final Program and Proceedings of IS&T and SPSTJ, Ventura, Calif., Sep. 13-15, 2004, pp. 28-31, Society for Imaging Science and Technology, Springfield, Va., U.S. Pat. No. 6,566,042 (Goto et al.), U.S. Pat. No. 7,129,032 (Mori et al.), and U.S. Pat. No. 7,267,934 (Goto), and U.S. Patent Application Publications 2004/234906 (Ohzeki et al.) and 2005/048422 (Nakagawa).

Thermal solvents (or melt formers) can also be used, including combinations of such compounds (for example, a combination of succinimide and dimethylurea). Thermal solvents are compounds which are solids at ambient temperature but which melt at the temperature used for processing. The thermal solvent acts as a solvent for various components of the photothermographic material, it helps to accelerate thermal development and it provides the medium for diffusion of various materials including silver ions and/or complexes and reducing agents. Known thermal solvents are disclosed in U.S. Pat. No. 3,438,776 (Yudelson), U.S. Pat. No. 5,064,753 (noted above) U.S. Pat. No. 5,250,386 (Aono et al.), U.S. Pat. No. 5,368,979 (Freedman et al.), U.S. Pat. No. 5,716,772 (Taguchi et al.), and U.S. Pat. No. 6,013,420 (Windender). Thermal solvents are also described in U.S. Pat. No. 7,169,544 (Chen-Ho et al.).

The photothermographic materials can also include one or more image stabilizing compounds that are usually incorporated in a "backside" layer. Such compounds can include phthalazinone and its derivatives, pyridazine and its derivatives, benzoxazine and benzoxazine derivatives, benzothiazine dione and its derivatives, and quinazoline dione and its derivatives, particularly as described in U.S. Pat. No. 6,599,685 (Kong). Other useful backside image stabilizers include anthracene compounds, coumarin compounds, benzophenone compounds, benzotriazole compounds, naphthalic acid imide compounds, pyrazoline compounds, or compounds described in U.S. Pat. No. 6,465,162 (Kong et al) and GB 1,565,043 (Fuji Photo).

Phosphors are materials that emit infrared, visible, or ultraviolet radiation upon excitation and can be incorporated into the photothermographic materials. Particularly useful phosphors are sensitive to X-radiation and emit radiation primarily in the ultraviolet, near-ultraviolet, or visible regions of the spectrum (that is, from about 100 to about 700 nm). An intrinsic phosphor is a material that is naturally (that is, intrinsically) phosphorescent. An "activated" phosphor is one composed of a basic material that may or may not be an intrinsic phosphor, to which one or more dopant(s) has been intentionally added. These dopants or activators "activate" the phosphor and cause it to emit ultraviolet or visible radiation. Multiple dopants may be used and thus the phosphor would include both "activators" and "co-activators".

Any conventional or useful phosphor can be used, singly or in mixtures. For example, useful phosphors are described in numerous references relating to fluorescent intensifying screens as well as U.S. Pat. No. 6,440,649 (Simpson et al.) and U.S. Pat. No. 6,573,033 (Simpson et al.) that are directed to photothermographic materials. Some particularly useful phosphors are primarily "activated" phosphors known as phosphate phosphors and borate phosphors. Examples of these phosphors are rare earth phosphates, yttrium phosphates, strontium phosphates, or strontium fluoroborates (including cerium activated rare earth or yttrium phosphates, or europium activated strontium fluoroborates) as described in U.S. Pat. No. 7,074,549 (Simpson et al.).

The one or more phosphors can be present in the photothermographic materials in an amount of at least 0.1 mole per mole, and typically from about 0.5 to about 20 mole, per mole of total silver in the photothermographic material. As noted above, generally, the amount of total silver is at least 0.002 mol/m$^2$. While the phosphors can be incorporated into any imaging layer on one or both sides of the support, typically they are in the same layer(s) as the photosensitive silver halide(s) on one or both sides of the support.

It is also useful that the photothermographic materials include one or more nucleation promoting phosphonium salts in the photothermographic emulsion layer or in a layer adjacent thereto. Such compounds have been described in U.S. Pat. No. 5,968,725 (Katoh et al.), U.S. Pat. No. 6,090,538 (Arai et al.), and U.S. Pat. No. 6,203,972 (Katoh et al.).

Binder:

The photosensitive silver halide (when present), the non-photosensitive source of reducible silver ions, the reducing agent composition, and any other imaging layer additives are generally combined with one or more hydrophobic binders. Generally the binder is selected from predominantly hydrophobic polymeric materials (at least 50 dry weight % of total binders) and the imaging layer formulation (and other layer formulations) is coated out of one or more organic solvents (described below).

Examples of typical hydrophobic binders include polyvinyl acetals and copolymers (including terpolymers) thereof. Non-limiting examples of polyvinyl acetals include polyvinyl butyral, polyvinyl acetal, and polyvinyl formal. More typically, polyvinyl butyral is used as the hydrophobic binder. Suitable polyvinyl butyral resins include those available under the names MOWITAL® (Kuraray America, New York, N.Y.), S-LEC® (Sekisui Chemical Company, Troy, Mich.), BUTVAR® (Solutia, Inc., St. Louis, Mo.) and PIOLOFORM® (Wacker Chemical Company, Adrian, Mich.).

Hardeners for the various binders may be present if desired. Useful hardeners are well known and include diisocyanate compounds as described in EP 0 600 586 B1 (Philip, Jr. et al.), vinyl sulfone compounds as described in U.S. Pat. No. 6,143,487 (Philip, Jr. et al.) and EP 0 640 589 A1 (Gathmann et al.), aldehydes and various other hardeners as described in U.S. Pat. No. 6,190,822 (Dickerson et al.). Useful hardeners are also described, for example, in T. H. James, *The Theory of the Photographic Process*, Fourth Edition, Eastman Kodak Company, Rochester, N.Y., 1977, Chapter 2, pp. 77-8.

Where the proportions and activities of the photothermographic materials require a particular developing time and temperature, the binder(s) should be able to withstand those conditions. It is desired that the binder (or mixture thereof) does not decompose or lose its structural integrity at 120° C. for 60 seconds. In some embodiments the binder should not decompose or lose its structural integrity at 177° C. for 60 seconds.

The polymer binder(s) is used in an amount sufficient to carry the components dispersed therein. For example, a binder is used at a level of from about 10% to about 90% by weight (typically at a level of from about 20% to about 70% by weight) based on the total dry weight of the layer. It is also useful that the thermally developable materials include at least 50 weight % hydrophobic binders in both imaging and non-imaging layers on both sides of the support.

Support Material:

The thermally developable materials comprise a polymeric support that is typically a flexible, transparent film that has any desired thickness and is composed of one or more polymeric materials. They are required to exhibit dimensional stability during thermal development and to have suitable adhesive properties with overlying layers. Useful polymeric materials for making such supports include polyesters [such as poly(ethylene terephthalate) and poly(ethylene naphthalate)], cellulose acetate and other cellulose esters, polyvinyl acetal, polyolefins, polycarbonates, and polystyrenes. Useful supports are composed of polymers having good heat stability, such as polyesters and polycarbonates. Support materials may also be treated or annealed to reduce shrinkage and promote dimensional stability.

Also useful are transparent, multilayer, polymeric supports comprising numerous alternating layers of at least two different polymeric materials as described in U.S. Pat. No. 6,630,283 (Simpson et al.). Another support comprises dichroic mirror layers as described in U.S. Pat. No. 5,795,708 (Boutet).

Opaque supports can also be used, such as dyed polymeric films and resin-coated papers that are stable to high temperatures.

Support materials can contain various colorants, pigments, antihalation or acutance dyes if desired. For example, the support can include one or more dyes that provide a blue color in the resulting imaged film. Support materials may be treated using conventional procedures (such as corona discharge) to improve adhesion of overlying layers, or subbing or other adhesion-promoting layers can be used.

The Protective Overcoat Layer:

As discussed above, protective overcoats for thermally developable materials typically comprise predominately cellulose acetate butyrate (CAB) polymers. While adequate for some purposes, CAB is somewhat soft and its use can lead to sticking, scratching, and marring during feeding, imaging, and particularly during thermal development of the thermally developed materials. We have found that a mixture of an alkyl vinyl ether/maleic anhydride copolymer or an alkylethylene/maleic anhydride copolymer with cellulose acetate provides a protective overcoat for thermally developable materials. This protective overcoat exhibits good adhesion to the emulsion layer, is harder than previously used overcoats, has good optical clarity, and has little effect on the sensitometric properties of the thermally developable material.

In one embodiment, the thermally developable material comprises a support having on at least one side thereon, one or more buried thermally developable imaging layers comprising a polyvinyl acetal binder, and in reactive association, a non-photosensitive source of reducible silver ions, and a reducing agent composition for the non-photosensitive source reducible silver ions, and having disposed over the one or more buried thermally developable imaging layers, an outermost overcoat layer comprising a mixture of a cellulose acetate polymer and one or more of an alkyl vinyl ether/maleic anhydride copolymer or an alkylethylene/maleic anhydride copolymer or mixtures thereof. The outermost overcoat layer can further comprise a surfactant. Typically, the buried thermally developable layer is a photothermographic layer and the binder comprises polyvinyl butyral.

In another embodiment, the thermally developable material comprises a support having on at least one side thereon, one or more buried thermally developable imaging layers comprising a polyvinyl acetal binder, and in reactive association, a non-photosensitive source of reducible silver ions, and a reducing agent composition for the non-photo-sensitive source reducible silver ions, and having disposed over the one or more buried thermally developable imaging layers, an outermost overcoat layer comprising a mixture of a cellulose acetate polymer and one or more of an alkyl vinyl ether/maleic anhydride copolymer or an alkylethylene/maleic anhydride copolymer or mixtures thereof. An interlayer comprising an alkyl vinyl ether/maleic anhydride copolymer or an alkylethylene/maleic anhydride copolymer or mixtures thereof is located between the thermally developable layer(s) and the outermost overcoat layer. The outermost overcoat layer can further comprise a surfactant. Typically, the buried thermally developable layer is a photothermographic layer and the binder comprises polyvinyl butyral.

In yet another embodiment, the thermally developable material comprises a support having on at least one side thereon, one or more buried thermally developable imaging layers comprising a polyvinyl acetal binder, and in reactive association, a non-photosensitive source of reducible silver ions, and a reducing agent composition for the non-photosensitive source reducible silver ions, and having disposed over the one or more buried thermally developable imaging layers, an outermost overcoat layer comprising a cellulose acetate polymer. An interlayer comprising an alkyl vinyl ether/maleic anhydride copolymer or an alkylethylene/maleic anhydride copolymer or mixtures thereof is located between the thermally developable layer(s) and the outermost overcoat layer. The outermost overcoat layer can further comprise a surfactant. Typically, the buried thermally developable layer is a photothermographic layer and the binder comprises polyvinyl butyral.

In a further embodiment, the thermally developable material comprises a support having on at least one side thereon, one or more buried thermally developable imaging layers comprising a polyvinyl acetal binder, and in reactive association, a non-photosensitive source of reducible silver ions, and a reducing agent composition for the non-photo-sensitive source reducible silver ions, and having disposed over the one or more buried thermally developable imaging layers, an outermost overcoat layer comprising a mixture of a cellulose acetate polymer and one or more of an alkyl vinyl ether/maleic anhydride copolymer or an alkylethylene/maleic anhydride copolymer or mixtures thereof. An interlayer comprising a cellulose acetate polymer and an alkyl vinyl ether/maleic anhydride copolymer or an alkylethylene/maleic anhydride copolymer or mixtures thereof is located between the thermally developable layer(s) and the outermost overcoat layer. The outermost overcoat layer can further comprise a surfactant. Typically, the buried thermally developable layer is a photothermographic layer and the binder comprises polyvinyl butyral.

In yet a further embodiment the thermally developable material comprises a support having on at least one side thereon, one or more buried thermally developable imaging layers comprising a polyvinyl acetal binder, and in reactive association, a non-photosensitive source of reducible silver ions, and a reducing agent composition for the non-photosensitive source reducible silver ions, and having disposed over the one or more buried thermally developable imaging layers, an outermost overcoat layer comprising a cellulose acetate polymer. An interlayer comprising a cellulose acetate polymer and an alkyl vinyl ether/maleic anhydride copolymer or an alkylethylene/maleic anhydride copolymer or mixtures thereof is located between the thermally developable layer(s) and the outermost overcoat layer. The outermost overcoat layer can further comprise a surfactant. Typically, the buried thermally developable layer is a photothermographic layer and the binder comprises polyvinyl butyral.

Generally, the alkyl group of the alkyl vinyl ether/maleic anhydride copolymer used in preparing the alkyl vinyl ether/maleic anhydride copolymer for use in the outermost overcoat layer and interlayer contains from about 1 to about 4 carbon atoms. Typical alkyl vinyl ethers include methyl vinyl ether, ethyl vinyl ether, propyl vinyl ether, and butyl vinyl ether. More typically methyl vinyl ether and ethyl vinyl ether are used. Most typically methyl vinyl ether is used.

Generally, the alkylethylene compounds of the alkylethylene/maleic anhydride polymer for use in the outermost overcoat layer and interlayer, contains from about 6 to about 18 carbon atoms and more typically from about 12 to about 18 carbon atoms. Typical alkylethylene compounds include 1-dodecene, 1-hexadecene, and 1-octadecene. Upon copolymerization with maleic anhydride these provide decyl, tetradecyl, and hexadecyl alkyl groups.

Cellulose acetate is available in various grades with acetyl contents of about 30 to about 40 percent. It is available, for example, from Eastman Chemical Co., Kingsport, Tenn.

The use of interlayers is often advantageous as it permits various additives to be located in different layers. This can often reduce the amounts of these additives that are needed. For example, matte agents and anti-slip agents can be located in the outermost layer and benzotriazole can be located in the interlayer.

If desired, one or more interlayers can be used.

The weight ratio of alkyl vinyl ether/maleic anhydride copolymer or alkylethylene/maleic anhydride polymer to cellulose acetate polymer in the protective overcoat layer is generally from about 1:99 to about 99:1, and typically from about 1:9 to about 3:7. Amore typical polymer combination is of methyl vinyl ether/maleic anhydride copolymer and cellulose acetate having a weight ratio of about 1:5.

The dry thickness of the outermost overcoat layer is generally from about 1 to about 3 μm, and typically from about 2 μm to about 3 μm. When an interlayer is present, the combined dry thickness of the outermost overcoat layer and interlayer also is generally from about 1 μm to about 3 μm, and typically from about 2 μm to about 3 μm.

Surfactant:

Surfactants, or surface active agents, are well known and useful in this invention. Surfactants can be broadly defined as compounds that concentrate at surfaces (interfaces). The interfacial activity of these substances gives rise to a wide range of surface chemistry functions: wetting, emulsifying, solubilizing, foaming/defoaming, rheology-modifying, antistatic (or triboelectric) control, 'glossing', lubricity and surface conditioning. Many suitable surfactants are commercially available. Examples of typical surfactants include sodium lauryl sulfate, cetyl trimethylammonium bromide, lauryl alcohol ethoxylate, laurylamidopropyl betaine, and perfluoroalkyl surfactants. Both ionic and non-ionic surfactants can be used in this invention but fluorosurfactants are preferred. Surfactants are especially beneficial in providing triboelectric control and improved adhesion.

Other typical fluorosurfactants include polyacrylates, polymethyacrylates, polyurethanes, polyethers, and polyesters containing fluorine-substituted aliphatic moieties of 4 to 16 carbon atoms, wherein the aliphatic moieties can contain mixtures of aliphatic chains varying from 4 to 16 carbon atoms. Further examples of fluorosurfactants are described in U.S. Pat. No. 6,548,240 (Yamaguchi), U.S. Pat. No. 6,190,854 (Sampei) and U.S. Pat. No. 7,427,467 (Teranishi).

Examples of commercially available surfactants that are useful in the present invention include the following:

EFKA®-3277 fluorocarbon modified polyacrylate. It is available from Ciba Specialty Chemicals (Basel, Switzerland).

LAROSTAT® 902A is N,N-bis(hydroxyethyl) coco amides (80%) and dodecylbenzenesulfonic acid diethanolamine salt (20%) (available from BASF).

LODYNEL® S-100 is a non-ionic fluorosurfactant available from Ciba Specialty Chemicals (Basel, Switzerland). It is a mixture of compounds of the formulae $Rf\text{-}(CH_2)_2\text{—}S\text{—}CH(CO_2H)CH_2CONH(CH_2)_3\text{—}N(CH_3)_2$ and $Rf\text{-}(CH_2)_2\text{—}S\text{—}CH(CH_2CO_2H)CONH(CH_2)_3\text{—}N(CH_3)_2$, where Rf is a mixture of $C_6F_{13}$, $C_8F_{17}$ and $C_{10}F_{21}$.

MASURF® FP-320 is a fluoroacrylate copolymer emulsion (22%), in water (63%), diethyl succinate (10%), and dipropylglycol (5%), cationic, (available from Mason Chemical Co.).

MASURF® FS-810 is a fluoroaliphatic polyacrylate oligimer (11%) in water (63%) and dipropyl glycol monomethyl ether (26%), nonionic, (available from Mason Chemical Co.).

MASURF® FS-910 is a fluoroacrylate copolymer solution in isoparaffin (89%), nonionic, (available from Mason Chemical Co.).

NOVEC™ FC-4434, 25% is a fluoroaliphatic polymeric ester (25%) in dipropylene glycol monomethyl ether (available from 3M).

SURFLON® S-386 is a fluorochemical surfactant (available from AGC Seimi Chemical).

UNIDYNE® NS-1602 is a non-ionic fluoropolymer surfactant. It is available from Daikin America, Inc. (Orangeburg, N.Y.).

UNIDYNE™ NS-1603 is a fluoroaliphatic polymer (30%) in isopropanol. It is available from Daikin America, Inc. (Orangeburg, N.Y.).

ZONYL® 9360 is an anionic fluoropolymer (29-33%) in propylene glycol (57-69%) and water (29-33%), anionic, (available from DuPont).

ZONYL® 8867L is a fluorinated substituted urethane (20-40%) in water, nonionic, (available from DuPont).

ZONYL® FSG is a fluorinated methacrylate polymer (40%) in Isopar H (60%), nonionic, (available from DuPont).

ZONYL® is a non-ionic fluorosurfactant available from DuPont and having the formula $Rf\text{-}CH_2CH_2\text{—}O\text{—}(CH_2CH_2O)_x\text{—}H$ where Rf is a mixture of fluoroalkyl groups averaging about $C_8F_{17}$ and x is 8-12.

In the present invention, the surfactant can be used in any amount that is effective to serve as a triboelectric charge control agent and adhesion promoter. Typical amounts for use in either the backing layer or the protective overcoat layer are in the range of from about 0.005 to about 2.0 total weight percent of all components in the overcoat. More typically the amounts are in the range of from about 0.01 to about 1.0 weight percent of all components in the overcoat formulation.

Thermally Developable Formulations and Constructions:

An organic solvent-based coating formulation for the thermally developable emulsion layer(s), outermost overcoat layers, and interlayers (when present) described herein can be prepared by mixing the various components with one or more binders in a suitable organic solvent system that usually includes one or more solvents such as toluene, 2-butanone (methyl ethyl ketone), acetone, or tetrahydrofuran, or mixtures thereof. Methyl ethyl ketone is a useful coating solvent. Generally, polyvinyl acetals are used as the polymer binder. Typically the binder is a polyvinyl butryal.

The thermally developable materials can contain plasticizers and lubricants such as poly(alcohols) and diols as described in U.S. Pat. No. 2,960,404 (Milton et al.), fatty acids or esters as described in U.S. Pat. No. 2,588,765 (Robijns) and U.S. Pat. No. 3,121,060 (Duane), and silicone resins as described in GB 955,061 (DuPont). The materials can also contain inorganic and organic matting agents as described in U.S. Pat. No. 2,992,101 (Jelley et al.) and U.S. Pat. No. 2,701,245 (Lynn). Polymeric fluorinated surfactants may also be useful in one or more layers as described in U.S. Pat. No. 5,468,603 (Kub).

U.S. Pat. No. 6,436,616 (Geisler et al.) describes various means of modifying photothermographic materials to reduce what is known as the "woodgrain" effect, or uneven optical density.

To promote image sharpness, the photothermographic materials can contain one or more layers containing acutance and/or antihalation dyes. These dyes are chosen to have absorption close to the exposure wavelength and are designed to absorb scattered light. One or more antihalation compositions may be incorporated into the support, backside layers, underlayers, or overcoat layers. Additionally, one or more acutance dyes may be incorporated into one or more frontside imaging layers.

Dyes useful as antihalation and acutance dyes include squaraine dyes as described in U.S. Pat. No. 5,380,635 (Gomez et al.), and U.S. Pat. No. 6,063,560 (Suzuki et al.), and EP 1 083 459 A1 (Kimura), indolenine dyes as described in EP 0 342 810 A1 (Leichter), and cyanine dyes as described in U.S. Pat. No. 6,689,547 (Hunt et al.).

It may also be useful to employ compositions including acutance or antihalation dyes that will decolorize or bleach with heat during processing as described in U.S. Pat. No. 5,135,842 (Kitchin et al.), U.S. Pat. No. 5,266,452 (Kitchin et al.), U.S. Pat. No. 5,314,795 (Helland et al.), and U.S. Pat. No. 6,306,566, (Sakurada et al.), and Japan Kokai 2001-142175 (Hanyu et al.) and 2001-183770 (Hanyu et al.). Useful bleaching compositions are described in Japan Kokai 11-302550 (Fujiwara), 2001-109101 (Adachi), 2001-51371 (Yabuki et al.), and 2000-029168 (Noro).

Other useful heat-bleachable antihalation compositions can include an infrared radiation absorbing compound such as an oxonol dye or various other compounds used in combination with a hexaarylbiimidazole (also known as a "HABI"), or mixtures thereof. HABI compounds are described in U.S. Pat. No. 4,196,002 (Levinson et al.), U.S. Pat. No. 5,652,091 (Perry et al.), and U.S. Pat. No. 5,672,562 (Perry et al.). Examples of such heat-bleachable compositions are described for example in U.S. Pat. No. 6,455,210 (Irving et al.), U.S. Pat. No. 6,514,677 (Ramsden et al.), and U.S. Pat. No. 6,558,880 (Goswami et al.).

Under practical conditions of use, these compositions are heated to provide bleaching at a temperature of at least 90° C. for at least 0.5 seconds (typically, at a temperature of from about 100° C. to about 200° C. for from about 5 to about 20 seconds).

Mottle and other surface anomalies can be reduced by incorporating a fluorinated polymer as described, for example, in U.S. Pat. No. 5,532,121 (Yonkoski et al.) or by using particular drying techniques as described, for example in U.S. Pat. No. 5,621,983 (Ludemann et al.).

It is useful for the photothermographic material to include one or more radiation absorbing substances that are generally incorporated into one or more photothermographic layer(s) to provide a total absorbance of all layers on that side of the support of at least 0.1 (typically of at least 0.6) at the exposure wavelength of the photothermographic material. Where the imaging layers are on one side of the support only, it is also desired that the total absorbance at the exposure wavelength for all layers on the backside (non-imaging) side of the support be at least 0.2.

Thermographic and photothermographic formulations can be coated by various coating procedures including wire wound rod coating, dip coating, air knife coating, curtain coating, slide coating, or extrusion coating using hoppers of the type described in U.S. Pat. No. 2,681,294 (Beguin). Layers can be coated one at a time, or two or more layers can be coated simultaneously by the procedures described in U.S. Pat. No. 2,761,791 (Russell), U.S. Pat. No. 4,001,024 (Dittman et al.), U.S. Pat. No. 4,569,863 (Keopke et al.), U.S. Pat. No. 5,340,613 (Hanzalik et al.), U.S. Pat. No. 5,405,740 (LaBelle), U.S. Pat. No. 5,415,993 (Hanzalik et al.), U.S. Pat. No. 5,525,376 (Leonard), U.S. Pat. No. 5,733,608 (Kessel et al.), U.S. Pat. No. 5,849,363 (Yapel et al.), U.S. Pat. No. 5,843,530 (Jerry et al.), and U.S. Pat. No. 5,861,195 (Bhave et al.), and GB 837,095 (Ilford). A typical coating gap for the emulsion layer can be from about 10 to about 750 μm, and the layer can be dried in forced air at a temperature of from about 20° C. to about 100° C. The thickness of the layer can be selected to provide maximum image densities greater than about 0.2, and typically, from about 0.5 to 5.0 or more, as measured by an X-rite Model 361/V Densitometer equipped with 301 Visual Optics, available from X-rite Corporation, (Granville, Mich.).

In general, two or more layer formulations are simultaneously applied to a support using slide coating techniques, the first layer being coated on top of the second layer while the second layer is still wet. The first and second fluids used to coat these layers can be the same or different solvents. For example, subsequently to, or simultaneously with, application of the emulsion formulation(s) to the support, the protective overcoat and interlayer formulations described herein can be applied over the emulsion formulation. Simultaneous coating can be used to apply layers on the frontside, backside, or both sides of the support.

In other embodiments, a "carrier" layer formulation comprising a single-phase mixture of two or more polymers described above may be applied directly onto the support and thereby located underneath the emulsion layer(s) as described in U.S. Pat. No. 6,355,405 (Ludemann et al.). The carrier layer formulation can be simultaneously applied with application of the emulsion layer formulation(s) and any overcoat or surface protective layers.

The thermally developable materials can include one or more antistatic or conductive layers agents in any of the layers on either or both sides of the support. Conductive components include soluble salts, evaporated metal layers, or ionic polymers as described in U.S. Pat. No. 2,861,056 (Minsk) and U.S. Pat. No. 3,206,312 (Sterman et al.), insoluble inorganic salts as described in U.S. Pat. No. 3,428,451 (Trevoy), electroconductive underlayers as described in U.S. Pat. No. 5,310,640 (Markin et al.), electronically-conductive metal antimonate particles as described in U.S. Pat. No. 5,368,995 (Christian et al.), and electrically-conductive metal-containing particles dispersed in a polymeric binder as described in EP 0 678 776 A1 (Melpolder et al.). Particularly useful conductive particles are the non-acicular metal antimonate particles used in a buried backside conductive layer as described and in U.S. Pat. No. 6,689,546 (LaBelle et al.), U.S. Pat. No. 7,018,787 (Ludemann et al.), and U.S. Pat. No. 7,022,467 (Ludemann et al.), U.S. Pat. No. 7,067,242 (Ludemann et al.), U.S. Pat. No. 7,087,364 (Ludemann et al.), U.S. Pat. No. 7,144,689 (Ludemann et al.), and U.S. Pat. No. 7,153,636 (Ludemann et al.).

It is particularly useful that the conductive layers be disposed on the backside of the support and especially where they are buried or underneath one or more other layers such as backside protective layer(s). Such backside conductive layers typically have a resistivity of about $10^5$ to about $10^{12}$ ohm/sq as measured using a salt bridge water electrode resistivity measurement technique. This technique is described in R. A. Elder *Resistivity Measurements on Buried Conductive Layers*, EOS/ESD Symposium Proceedings, Lake Buena Vista, Fla., 1990, pp. 251-254, incorporated herein by reference. [EOS/ESD stands for Electrical Overstress/Electrostatic Discharge].

Still other conductive compositions include one or more fluorochemicals each of which is a reaction product of $R_f$—$CH_2CH_2$—$SO_3H$ with an amine wherein $R_f$ comprises 4 or more fully fluorinated carbon atoms as described in U.S. Pat. No. 6,699,648 (Sakizadeh et al.). Additional conductive compositions include one or more fluorochemicals described in more detail in U.S. Pat. No. 6,762,013 (Sakizadeh et al.).

The thermally developable materials may also usefully include a magnetic recording material as described in *Research Disclosure*, Item 34390, November 1992, or a transparent magnetic recording layer such as a layer containing magnetic particles on the underside of a transparent support as described in U.S. Pat. No. 4,302,523 (Audran et al.).

While the carrier and emulsion layers can be coated on one side of the film support, manufacturing methods can also include forming on the opposing or backside of the polymeric support, one or more additional layers, including a conductive layer, antihalation layer, or a layer containing a matting agent (such as silica), or a combination of such layers. Alternatively, one backside layer can perform all of the desired functions.

In some embodiments, a conductive "carrier" layer formulation comprising a single-phase mixture of two or more polymers and non-acicular metal antimonate particles, may be applied directly onto the backside of the support and thereby be located underneath other backside layers. The carrier layer formulation can be simultaneously applied with application of these other backside layer formulations.

It is also contemplated that the photothermographic materials include one or more photothermographic layers on both sides of the support and/or an antihalation underlayer beneath at least one photothermographic layer on at least one side of the support. In addition, the materials can have an outermost protective layer disposed over all photothermographic layers on both sides of the support.

Imaging/Development:

The photothermographic materials can be imaged in any suitable manner consistent with the type of material, using any suitable imaging source to which they are sensitive (typically some type of radiation or electronic signal). In most embodiments, the materials are sensitive to radiation in the range of from about at least 100 nm to about 1400 nm. In some embodiments, the materials are generally sensitive to radiation in the range of from about 300 nm to about 600 nm, typically from about 300 to about 450 nm, or from a wavelength of from about 360 to 420 nm. In other embodiments the materials are sensitized to radiation from about 600 to about 1200 nm and typically to infrared radiation from about 700 to about 950 nm. If necessary, sensitivity to a particular wavelength can be achieved by using appropriate spectral sensitizing dyes.

Imaging can be carried out by exposing the photothermographic materials to a suitable source of radiation to which they are sensitive, including X-radiation, ultraviolet radiation, visible light, near infrared radiation, and infrared radiation to provide a latent image. Suitable exposure means are well known and include phosphor emitted radiation (particularly X-ray induced phosphor emitted radiation), incandescent or fluorescent lamps, xenon flash lamps, lasers, laser diodes, light emitting diodes, infrared lasers, infrared laser diodes, infrared light-emitting diodes, infrared lamps, or any other ultraviolet, visible, or infrared radiation source readily apparent to one skilled in the art such as described in *Research Disclosure*, item 38957 (noted above). Particularly useful infrared exposure means include laser diodes emitting at from about 700 to about 950 nm, including laser diodes that are modulated to increase imaging efficiency using what is known as multi-longitudinal exposure techniques as described in U.S. Pat. No. 5,780,207 (Mohapatra et al.). Other exposure techniques are described in U.S. Pat. No. 5,493,327 (McCallum et al.).

The photothermographic materials also can be indirectly imaged using an X-radiation imaging source and one or more prompt-emitting or storage X-radiation sensitive phosphor screens adjacent to the photothermographic material. The phosphors emit suitable radiation to expose the photothermographic material. Useful X-ray screens are those having phosphors emitting in the near ultraviolet region of the spectrum (from 300 to 400 nm), in the blue region of the spectrum (from 400 to 500 nm), and in the green region of the spectrum (from 500 to 600 nm).

In other embodiments, the photothermographic materials can be imaged directly using an X-radiation imaging source to provide a latent image.

Thermal development conditions will vary, depending on the construction used but will typically involve heating the imagewise exposed photothermographic material at a suitably elevated temperature, for example, at from about 50° C. to about 250° C. (typically from about 80° C. to about 200° C. or from about 100° C. to about 200° C.) for a sufficient period of time, generally from about 1 to about 120 seconds. Heating can be accomplished using any suitable heating means such as contacting the material with a heated drum, plates, or rollers, or by providing a heating resistance layer on the rear surface of the material and supplying electric current to the layer so as to heat the material. One useful heat development procedure for photothermographic materials includes heating within a temperature range of from 110 to 150° C. for 25 seconds or less, for example, at least 3 and up to 25 seconds (and typically for 20 seconds or less) to develop the latent image into a visible image having a maximum density (Dmax) of at least 3.0. Line speeds during development of greater than 61 cm/min, such as from 61 to 200 cm/min, can be used.

When imaging direct thermographic materials, the image may be "written" simultaneously with development at a suitable temperature using a thermal stylus, a thermal print-head or a laser, or by heating while in contact with a heat-absorbing material. The thermographic materials may include a dye (such as an IR-absorbing dye) to facilitate direct development by exposure to laser radiation.

Thermal development of either thermographic or photothermographic materials is carried out with the material being in a substantially water-free environment and without application of any solvent to the material.

Use as a Photomask:

The thermographic and photothermographic materials can be sufficiently transmissive in the range of from about 350 to about 450 nm in non-imaged areas to allow their use in a method where there is a subsequent exposure of an ultraviolet or short wavelength visible radiation sensitive imageable medium. The photothermographic materials absorb ultraviolet or short wavelength visible radiation in the areas where there is a visible image and transmit ultraviolet or short wavelength visible radiation where there is no visible image. The photothermographic materials may then be used as a mask and positioned between a source of imaging radiation (such as an ultraviolet or short wavelength visible radiation energy source) and an imageable material that is sensitive to such imaging radiation, such as a photopolymer, diazo material, photoresist, or photosensitive printing plate. Exposing the imageable material to the imaging radiation through the visible image in the exposed and heat-developed photothermographic material provides an image in the imageable material. This method is particularly useful where the imageable medium comprises a printing plate and the photothermographic material serves as an image-setting film.

Thus, in some other embodiments wherein the thermally developable material is a thermographic or photothermographic material comprising a transparent support, the image-forming method further comprises, after steps (A) and (B) or step (A') noted above:

(C) positioning the exposed and heat-developed thermographic or photothermographic material between a source of imaging radiation and an imageable material that is sensitive to the imaging radiation, and (D) exposing the imageable material to the imaging radiation through the visible image in the exposed and heat-developed thermographic or photothermographic material to provide an image in the imageable material.

The following examples are provided to illustrate the practice of the present invention and the invention is not meant to be limited thereby.

Materials and Methods for the Examples:

All materials used in the following examples are readily available from standard commercial sources, such as Aldrich Chemical Co. (Milwaukee Wis.), or were prepared by known methods. All percentages are by weight unless otherwise indicated. The following additional terms and materials were used.

Many of the chemical components used herein are provided as a solution. The term "active ingredient" means the amount or the percentage of the desired chemical component contained in a sample. All amounts listed herein are the amount of active ingredient added unless otherwise specified.

BZT is benzotriazole.

CA398-6 is a cellulose acetate resin available from Eastman Chemical Co (Kingsport, Tenn.).

CAB 171-15S is a cellulose acetate butyrate resin available from Eastman Chemical Co (Kingsport, Tenn.).

DESMODUR® N-75 BA is an aliphatic polyisocyanate resin based on hexamethylene diisocyanate (HDI) and dissolved in n-butyl acetate. DESMODUR® N3300 is a trimer of an aliphatic hexamethylene diisocyanate. Both are available from Bayer Chemicals (Pittsburgh, Pa.).

Developer A is 1,1'-bis(2-hydroxy-3,5-dimethylphenyl) isobutane.

GANTREZ® resins are copolymers of methyl vinyl ether and maleic anhydride differentiated by molecular weight. GANTREZ® AN-139 has an approximate Mw of 690,000. GANTREZ® AN-149 has an approximate Mw of 1,250,000. GANTREZ AN-169 has an approximate Mw of 2,500,000. All are products of International Specialty Products, (Wayne, N.J.).

MEK is methyl ethyl ketone (or 2-butanone).

MVEM-1 is poly(methyl vinyl ether-alt-maleic anhydride). It has an approximate Mw~216,000. It was obtained from Aldrich Chemical Company.

MVEM-2 is poly(methyl vinyl ether-alt-maleic anhydride). It has an approximate Mw~1,250,000. It was obtained from Aldrich Chemical Company.

PARALOID® A-21 is an acrylic copolymer available from Rohm and Haas (Philadelphia, Pa.).

PIOLOFORM® BL-16 is reported to be a polyvinyl butyral resin having a glass transition temperature of about 84° C. PIOLOFORM® BM-18 is reported to be a polyvinyl butyral resin having glass transition temperature of about 70° C. Both are available from Wacker Polymer Systems (Adrian, Mich.).

PMAO is Poly(maleic anhydride-alt-1-octadecene), Mw 30,000~50,000. It was obtained from Aldrich Chemical Company.

SYLYSIA® 310P is a synthetic amorphous silica available from Fuji Silysia (Research Triangle Park, N.C.).

Vinyl Sulfone-1 (VS-1) is described in U.S. Pat. No. 6,143,487 and has the following structure:

(VS-1)

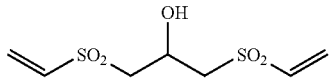

Antifoggant AF-A is 2-pyridyltribromomethylsulfone and has the following structure:

(AF-A)

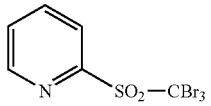

Antifoggant AF-B is ethyl-2-cyano-3-oxobutanoate. It is described in U.S. Pat. No. 5,686,228 (Murray et al.) and has the following structure:

(AF-B)

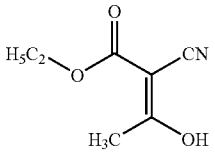

Acutance Dye AD-1 has the following structure:

(AD-1)

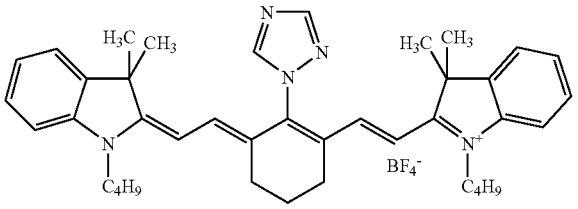

Sensitizing Dye A is described in U.S. Pat. No. 5,541,054 (Miller et al.) has the following structure:

(Sensitizing Dye A)

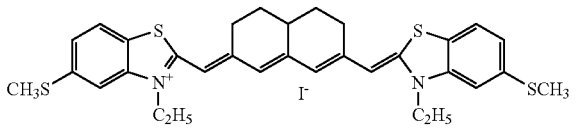

Support Dye SD-1 has the following structure:

(SD-1)

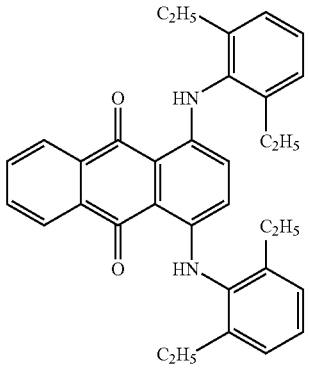

Tinting Dye TD-1 has the following structure:

(TD-1)

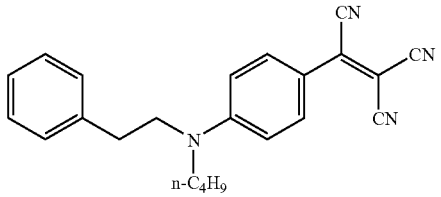

EXAMPLE 1

Preparation of Photothermographic Emulsion Formulation:

A preformed silver halide, silver carboxylate soap dispersion, was prepared in a manner similar to that described in U.S. Pat. No. 5,939,249. The core-shell silver halide emulsion had a silver iodobromide core with 8% iodide, and a silver bromide shell doped with iridium and copper. The core made up 25% of each silver halide grain, and the shell made up the remaining 75%. The silver halide grains were cubic in shape, and had a mean grain size between 0.055 and 0.06 μm. The preformed silver halide, silver carboxylate soap dispersion was made by mixing 26.1 % preformed silver halide, silver carboxylate soap, 2.1 % PIOLOFORM® BM-18 polyvinyl butyral binder, and 71.8% MEK, and homogenizing three times at 8000 psi (55 MPa).

A photothermographic emulsion formulation was prepared at 67° F. (19.4° C.) containing 174 parts of the above preformed silver halide, silver carboxylate soap dispersion and 22 parts of MEK. To this formulation was added 1.6 parts of a 15% solution of pyridinium hydrobromide perbromide in methanol, with stirring. After 60 minutes of mixing, 2.1 parts of an 11% zinc bromide solution in methanol was added. Stirring was continued and after 30 minutes, a solution of 0.15 parts 2-mercapto-5-methylbenzimidazole, 0.008 parts of Sensitizing Dye A, 1.66 parts of 2-(4-chlorobenzoyl)benzoic acid, 10.8 parts of methanol, and 3.4 parts of MEK were added. After stirring for 75 minutes, the temperature was lowered to 50° F. (10° C.), and 26.15 parts of PIOLOFORM® BM-18 and 19.83 parts of PIOLOFORM® BL-16 were added. Mixing was continued for another 15 minutes.

The emulsion formulation was completed by adding the materials shown below. Five minutes were allowed between the additions of each component.

Solution A containing:

| | |
|---|---|
| Antifoggant AF-A | 0.80 parts |
| Tetrachlorophthalic acid (TCPA) | 0.37 parts |
| 4-Methylphthalic acid (4-MPA) | 0.72 parts |
| MEK | 21 parts |
| Methanol | 0.36 parts |
| Developer A | 9.48 parts |
| DESMODUR ® N3300 Solution | 1.44 parts in 0.74 parts MEK |
| Phthalazine (PHZ) | 1.32 parts in 7.0 parts MEK |

Preparation of Overcoat Formulations:

Overcoat A—Comparative:

Comparative overcoat formulations (Samples 1-1 and 1-9) were prepared. They consisted of Cellulose Acetate Butyrate (CAB) and PARALOID® A-21 and were prepared by mixing the following materials:

| | |
|---|---|
| MEK | 166 parts |
| PARALOID ® A-21 | 1.06 parts |
| CAB 171-15S | 11.52 parts |
| Vinyl Sulfone VS-1 | 0.59 parts, 75% active |
| Benzotriazole (BZT) | 0.165 parts |
| Acutance Dye AD-1 | 0.32 parts |
| Antifoggant AF-B | 0.29 parts |
| Tinting Dye TD-1 | 0.012 parts |

Overcoat B—Inventive and Comparative:

Inventive overcoat formulations consisting of Cellulose Acetate and an alkyl vinyl ether/maleic anhydride copolymer or an alkylethylene/maleic anhydride copolymer were prepared by mixing the following materials:

Polymer Premix:

Cellulose Acetate (CA398-6) resin

Alkyl vinyl ether/maleic anhydride copolymer or alkylethylene/maleic anhydride copolymer

DESMODUR® N75 BA

UNIDYNEL NS-1602

Solvent (MEK, Acetone)

The weight ratios of each component in polymer premix are shown in TABLE I. Inventive Samples 1-2 through 1-8 contained DESMODUR® N75BA. Inventive Samples 1-10 through 1-18 contained UNIDYNEL NS-1602 surfactant. Comparative samples (Samples 1-2 and 1-10) were prepared similarly, but contained no alkyl vinyl ether/maleic anhydride copolymer or alkylethylene/maleic anhydride copolymer.

Antihalation Dye and Stabilizer Premix:

A premix of Antihalation Dye and Stabilizer was prepared by mixing the following materials:

| | |
|---|---|
| Vinyl Sulfone VS-1 | 0.53 parts, 83% active |
| Benzotriazole (BZT) | 0.329 parts |
| Acutance Dye AD-1 | 0.17 parts |
| Antifoggant AF-B | 0.29 parts |
| Tinting Dye TD-1 | 0.007 parts |

The final overcoat formulation was prepared by adding 1.6 parts of the Antihalation Dye and Stabilizer Premix to 16 parts of the polymer premix solution.

Preparation of Photothermographic Materials:

The photothermographic emulsion and overcoat solutions were simultaneously coated onto a 7 mil (178 μm) polyethylene terephthalate support, tinted blue with support dye SD-1. An automated dual knife coater was used. Immediately after coating, samples were dried in a forced air oven at 85° C. for 6 minutes. The photothermographic emulsion formulation was coated to obtain a coating weight of between about 1.9 and 2.0 g of total silver/$m^2$. The overcoat formulation was coated to obtain a dry coating weight of about 0.2 g/$ft^2$ (2.2 g/$m^2$) and an absorbance in the imaging layer between 0.8 and 0.9 at 815 nm.

The backside of the support had been coated with an antihalation and antistatic layer having an absorbance greater than 0.3 between 805 and 815 nm, and a resistivity $10^{11}$ ohms/square or less at 21.1° C. and 50% relative humidity and an outermost backside layer.

Testing of Photothermographic Materials:

Measurement of Adhesion:

Adhesion of the overcoat was measured in all samples before processing. Samples were evaluated using a "crosshatch" adhesion test performed according to ASTM D3359-92A. The emulsion side of a coated, unprocessed film was cut with a razor blade in a crosshatched pattern, a 1-inch (2.54 cm) wide piece of commercially available 3M Type 610 semi-transparent pressure-sensitive tape was placed on the pattern and then quickly lifted off. The amount of overcoat left on the emulsion layer is the measure of adhesion of overcoat to the emulsion layer. The adhesion test ratings are from 0 to 5 where 0 refers to complete removal of the overcoat and 5 refers none or very little overcoat removed. Arating of "3" or greater is considered to be acceptable. 3M Type 610 semi-transparent pressure-sensitive tape was obtained from 3M Company (Maplewood, Minn.).

Measurement of Haze:

Haze (%) was measured in the Dmin areas of samples after processing. Haze (%) was measured in accord with ASTM D 1003 by conventional means using a Haze-guard Plus Hazemeter that is available from BYK-Gardner (Columbia, Md.). The % Haze value is a good indication of polymer compatibility when more than one type of polymers is used in photothermographic coating constructions. Total haze for thermally developable materials should be as low as possible and preferably it should not be more than 30% from both emulsion side and the backcoat.

Measurement of Overcoat Hardness:

Nanoindentation hardness measurements of the overcoat layers were made with an UMIS2000 Ultra Micro Indentation System (Fischer-Cripps Laboratories Pty. Limited, Sydney, Australia) using a 2-micrometer spherical indenter.

The 1x range for both the depth and force on the instrument was selected. Measurements were made on the overcoat layers coated above the buried emulsion layers of the films. A minimum contact force of 0.005 mN or greater was initially applied. The force was then increased in various increments (ranging from 20-200 steps depending on the total force) using a ramping load with a timed dwell ranging from 0 to 5 seconds at each force level. At the maximum load (0.3 mN to 10 mN) the force was held constant to monitor the creep of the indenter into the overcoat. The maximum hold time ranged from 30 seconds to 10 minutes. The force was then decreased in various increments ranging from 20-200 steps, with a dwell time at each force level ranging from 0-5 seconds, until a reaching a contact force of 2% that of the initially applied contact force. Indentation depths were recorded at each increment as a function of the force applied.

The procedure for the examples below had an initial force of 0.005 mN followed by ramping to a maximum force of 0.5 mN using 60 load increments and a 0.5-second dwell at each increment. The indentation depth in microns was recorded as a function of the loading force at each load increment. The maximum force was held for 180 seconds and the indentation depth in microns was recorded at 6-second intervals. The unloading was also ramped using 60 load increments and a 0.5-second dwell at each increment. At each unloading increment, the indentation depth in microns was recorded as a function of the force applied during the unloading.

The hardness (H) calculations were made using the ratio of force vs. the contact area of the indenter with the measured surface. The contact area was derived as described for spherical indenter in *Nanoindentation*, Anthony C. Fischer-Cripps, 2nd Edition, Springer-Verlag, NY, 2004, pp 43-47.

Sensitometry:

Samples of each photothermographic material were cut into strips, imaged with a laser sensitometer at 810 nm. They were then thermally developed to generate continuous tone wedges with image densities varying from a minimum density (Dmin) to a maximum density (Dmax) possible for the exposure source and development conditions. Development was carried out on a 6 inch diameter (15.2 cm) heated rotating drum. The strip contacted the drum for 210 degrees of its revolution, about 11 inches (28 cm). Samples were developed at 122.5° C. for 15 seconds.

Densitometry measurements were made on a custom built computerized-scanning densitometer meeting ISO Standards 5-2 and 5-3 and are believed to be comparable to measurements from commercially available densitometers. Density of the wedges imaged above was measured using a filter appropriate to the sensitivity of the photothermographic material to obtain graphs of density versus log exposure (that is, DlogE curves).

Calculation of Silver Efficiency:

Silver efficiency was calculated for each sample by dividing Dmax by the silver coating weight. The silver coating weight of each film sample was measured by X-ray fluorescence using commonly known techniques.

Results:

The results are shown below in TABLE II. A comparison of Samples 1-1 and 1-2 demonstrate that a protective overcoat containing only cellulose acetate polymer (CA398-6) provides a much harder overcoat surface than similarly prepared overcoats containing cellulose acetate butyrate (CAB171-15).

Comparative Samples 1-2 and 1-10 further demonstrate that protective overcoats containing only cellulose acetate resin suffer from poorer adhesion to the emulsion layer when compared to Comparative Samples 1-1 and 1-9.

Samples 1-3 to 1-8 demonstrate that inventive overcoats containing a mixture of cellulose acetate and an alkyl vinyl ether/maleic anhydride or an alkylethylene/maleic anhydride exhibit very good adhesion to the emulsion layer and are harder than the comparative CAB samples (Samples 1-1 and 1-9).

Additionally, the low haze values for protective overcoats comprising a combination of cellulose acetate and an alkyl vinyl ether/maleic anhydride or an alkylethylene/maleic anhydride are similar to those of cellulose acetate used alone. This indicates the good compatibility a mixture of cellulose acetate and an alkyl vinyl ether/maleic anhydride or an alkylethylene/maleic anhydride.

Finally, the sensitomeric properties of samples comprising a mixture of cellulose acetate and an alkyl vinyl ether/maleic anhydride or an alkylethylene/maleic anhydride polymer are comparable to samples containing an overcoat of only cellulose acetate.

Samples 1-11 to 1-18 demonstrate further improvement in adhesion of a protective overcoat containing cellulose acetate to the emulsion layer through addition of surfactant NS-1602. For each pair of samples, (Samples 1-11 and 1-12, or Samples 1-13 and 1-14, or Samples 1-15 and 1-16, or Samples 1-17 and 1-18), the example with added NS-1602 surfactant had an adhesion level as good or better than the same protective overcoat without the addition of NS-1602 surfactant. The other measured properties are comparable to the comparative overcoat sample (1-10) containing only cellulose acetate.

TABLE I

Chemical Composition of Overcoat Solutions (in grams).

| Sample | Description | Eastman CAB 171-15 | Paraloid A21 | Eastman CA398-6 | MVEM1 | MVEM2 | Gantrez AN-139 | Gantrez AN-149 | Gantrez AN-169 | PMAO | N-75 | Unidyne NS-1602 | MEK | Acetone |
|---|---|---|---|---|---|---|---|---|---|---|---|---|---|---|
| 1-1 | Comparative | 7.05 | 0.65 | — | — | — | — | — | — | — | — | — | 92.3 | — |
| 1-2 | Comparative | — | — | 8.0 | — | — | — | — | — | — | 0.36 | — | 84.2 | 7.5 |
| 1-3 | Inventive | — | — | 7.6 | 0.4 | — | — | — | — | — | 0.36 | — | 84.2 | 7.5 |
| 1-4 | Inventive | — | — | 7.2 | 0.8 | — | — | — | — | — | 0.36 | — | 84.2 | 7.5 |
| 1-5 | Inventive | — | — | 6.4 | 1.6 | — | — | — | — | — | 0.36 | — | 84.2 | 7.5 |
| 1-6 | Inventive | — | — | 7.6 | — | 0.4 | — | — | — | — | 0.36 | — | 84.2 | 7.5 |
| 1-7 | Inventive | — | — | 7.2 | — | 0.8 | — | — | — | — | 0.36 | — | 84.2 | 7.5 |
| 1-8 | Inventive | — | — | 6.4 | — | 1.6 | — | — | — | — | 0.36 | — | 84.2 | 7.5 |
| 1-9 | Comparative | 7.05 | 0.65 | — | — | — | — | — | — | — | — | — | 92.3 | — |
| 1-10 | Comparative | — | — | 8.0 | — | — | — | — | — | — | — | — | 84.5 | 7.5 |
| 1-11 | Inventive | — | — | 6.4 | — | — | 1.6 | — | — | — | — | — | 84.5 | 7.5 |
| 1-12 | Inventive | — | — | 6.4 | — | — | 1.6 | — | — | — | — | 0.73 | 83.8 | 7.5 |
| 1-13 | Inventive | — | — | 6.4 | — | — | — | 1.6 | — | — | — | — | 84.5 | 7.5 |
| 1-14 | Inventive | — | — | 6.4 | — | — | — | 1.6 | — | — | — | 0.73 | 83.8 | 7.5 |
| 1-15 | Inventive | — | — | 6.4 | — | — | — | — | 1.6 | — | — | — | 84.5 | 7.5 |
| 1-16 | Inventive | — | — | 6.4 | — | — | — | — | 1.6 | — | — | 0.73 | 83.8 | 7.5 |
| 1-17 | Inventive | — | — | 6.4 | — | — | — | — | — | 1.6 | — | — | 84.5 | 7.5 |
| 1-18 | Inventive | — | — | 6.4 | — | — | — | — | — | 1.6 | — | 0.73 | 83.8 | 7.5 |

TABLE II

Adhesion, Hardness, and Sensitometric Properties of Photothermographic Material.

| Sample# | Description | Adhesion Unprocessed One Tape Lift-Off Test | Hardness Unprocessed (GPa × $10^3$) | Dmin % Haze Processed | Sensitometry (Processed for 15 s at 122.5° C.) Dmin | Dmax/Ag | Spd-3 | AC-1 |
|---|---|---|---|---|---|---|---|---|
| 1-1 | Comparative | 3 | 191 | 18.2 | 0.220 | 1.901 | 1.121 | 3.437 |
| 1-2 | Comparative | 0 | 211 | 16.5 | 0.216 | 1.902 | 1.083 | 3.568 |
| 1-3 | Inventive | 3 | 204 | 16.7 | 0.214 | 1.958 | 1.045 | 3.512 |
| 1-4 | Inventive | 3.5 | 221 | 17.2 | 0.218 | 1.900 | 1.015 | 3.753 |
| 1-5 | Inventive | 4 | 205 | 17.5 | 0.221 | 1.815 | 0.844 | 4.164 |
| 1-6 | Inventive | 1 | 220 | 17.2 | 0.219 | 1.945 | 1.125 | 3.550 |
| 1-7 | Inventive | 2 | 225 | 17.2 | 0.219 | 1.926 | 1.170 | 3.741 |
| 1-8 | Inventive | 4 | 228 | 17.0 | 0.217 | 2.013 | 0.992 | 3.941 |
| 1-9 | Comparative | 2 | 188 | 17.9 | 0.225 | 1.858 | 1.192 | 3.754 |
| 1-10 | Comparative | 0 | 204 | 18.2 | 0.232 | 1.905 | 1.267 | 3.964 |
| 1-11 | Inventive | 2 | 223 | 17.6 | 0.223 | 1.829 | 1.180 | 4.248 |
| 1-12 | Inventive | 5 | 224 | 17.1 | 0.225 | 1.875 | 1.184 | 4.135 |
| 1-13 | Inventive | 3 | 219 | 17.7 | 0.224 | 1.850 | 1.134 | 4.402 |
| 1-14 | Inventive | 5 | 221 | 18.6 | 0.224 | 1.878 | 1.219 | 4.553 |
| 1-15 | Inventive | 4 | 212 | 18.3 | 0.226 | 1.866 | 1.155 | 4.525 |
| 1-16 | Inventive | 5 | 226 | 18.0 | 0.224 | 1.908 | 1.222 | 4.622 |
| 1-17 | Inventive | 5 | 205 | 18.1 | 0.219 | 1.893 | 1.173 | 3.845 |
| 1-18 | Inventive | 5 | 208 | 18.3 | 0.221 | 1.882 | 1.183 | 3.789 |

EXAMPLE 2

This example demonstrates that adhesion of a cellulose acetate overcoat layer to the photothermographic emulsion layer can be significantly improved by introducing an interlayer between the imaging layer and the overcoat layer. The interlayer can consist of an alkyl vinyl ether/maleic anhydride or an alkylethylene/maleic anhydride polymer, or a mixture of cellulose acetate and an alkyl vinyl ether/maleic anhydride or an alkylethylene/maleic anhydride polymer.

The photothermographic emulsion layer formulation was as described above in Example 1.

Interlayer Formulation:

Interlayer solutions comprising cellulose acetate (CA-398-6) and additional components were prepared by mixing the appropriate materials as shown in Table III.

Overcoat Formulations:

Overcoat C—Inventive and Comparative:

Inventive overcoat formulations comprising cellulose acetate and an alkyl vinyl ether/maleic anhydride copolymer or an alkylethylene/maleic anhydride copolymer were prepared by mixing the materials shown below. Comparative overcoat formulations (Samples 2-1 and 2-2) contained no alkyl vinyl ether/maleic anhydride copolymer or alkylethylene/maleic anhydride copolymer.

Polymer Premix:

Cellulose Acetate (CA398-6) resin

Alkyl vinyl ether/maleic anhydride copolymer or alkylethylene/maleic anhydride copolymer

UNIDYNE® NS-1602

Solvent (MEK and Acetone)

The weight ratios of each component in polymer premix are shown in TABLE IV.

Antihalation Dye and Stabilizer Premix:

A premix of Antihalation Dye and Stabilizer was prepared by mixing the following materials:

| | |
|---|---|
| Vinyl Sulfone VS-1 | 2.07 parts, 83% active |
| Benzotriazole (BZT) | 0.428 parts |
| Acutance Dye AD-1 | 0.221 parts |
| Antifoggant AF-B | 1.677 parts |
| Tinting Dye TD-1 | 0.009 parts |

The final overcoat formulation was prepared by adding 1.6 parts of the Antihalation Dye and Stabilizer Premix to 16 parts of the polymer premix solution.

Preparation of Photothermographic Materials:

The photothermographic emulsion, interlayer, and overcoat solutions were simultaneously coated onto a 7 mil (178 μm) polyethylene terephthalate support, tinted blue with support dye SD-1. A manual triple-knife coater was used. Immediately after coating, samples were dried in a forced air oven at 85° C. for 6 minutes. The photothermographic emulsion formulation was coated to obtain a coating weight of between about 1.9 and 2.0 g of total silver/$m^2$. The overcoat and interlayer solutions were coated to obtain a dry coating weight of about 0.24 g/$ft^2$ (2.64 g/$m^2$) and an absorbance in the imaging layer between 0.7 and 0.8 at 815 nm. The thickness ration of interlayer vs. overcoat layer is 3:4.

The backside of the support had been coated with an antihalation and antistatic layer having an absorbance greater than 0.3 between 805 and 815 nm, and a resistivity of $10^{11}$ ohms/square or less at 21.1° C. and 50% relative humidity and an outermost backside layer.

Testing of Photothermographic Materials:

Measurement of Adhesion:

Adhesion of the overcoat was measured as described above in Example 1. In samples where surfactant was used to prepare the overcoat, the lift-off test was repeated three times using new pieces of tape for each lift-off test so that any surfactant residue on the overcoat surface could be removed during the first two "lift-offs". The results of the third lift-off test were recorded.

Haze (%) value and sensitometry measurements were carried out as described in Example 1.

Results:

The results, shown below in TABLE V, demonstrate that the introduction of and interlayer containing a mixture of an alkyl vinyl ether/maleic anhydride copolymer (GANTREZ® AN-169) and cellulose acetate (CA398-6) provides good adhesion of the overcoat layer to the interlayer and of the interlayer to the emulsion layer without significantly effecting sensitometric properties or haze. Samples containing only alkyl vinyl ether/maleic anhydride copolymer (GANTREZ® AN-169) as the interlayer also had good adhesion. In contrast, Samples 2-1 and 2-2 in which the interlayer contained only cellulose acetate had poor adhesion.

In these "trilayer" constructions, haze remained low and sensitometric properties were substantially unaffected.

TABLE III

Chemical Composition of Interlayer Solutions (in grams).

| Sample# | Description | Eastman CA398-6 | Gantrez AN-169 | MEK | Acetone |
|---|---|---|---|---|---|
| 2-1 | Comparative | 8.0 | None | 84.5 | 7.5 |
| 2-2 | Comparative | 8.0 | None | 84.5 | 7.5 |
| 2-3 | Inventive | 7.2 | 0.8 | 84.5 | 7.5 |
| 2-4 | Inventive | 6.8 | 1.2 | 84.5 | 7.5 |
| 2-5 | Inventive | 6.4 | 1.6 | 84.5 | 7.5 |
| 2-6 | Inventive | 6.0 | 2.0 | 84.5 | 7.5 |
| 2-7 | Inventive | 4.8 | 3.2 | 84.5 | 7.5 |
| 2-8 | Inventive | 4.8 | 3.2 | 84.5 | 7.5 |
| 2-9 | Inventive | 4.8 | 3.2 | 84.5 | 7.5 |
| 2-10 | Inventive | 3.2 | 4.8 | 84.5 | 7.5 |
| 2-11 | Inventive | 3.2 | 4.8 | 84.5 | 7.5 |
| 2-12 | Inventive | 3.2 | 4.8 | 84.5 | 7.5 |
| 2-13 | Inventive | None | 8.0 | 84.5 | 7.5 |

TABLE IV

Chemical Composition of Overcoat Solutions

| Sample# | Description | Eastman CA398-6 (g) | Gantrez AN-169 (g) | Unidyne NS-1602 (g) | MEK (g) | Acetone (g) |
|---|---|---|---|---|---|---|
| 2-1 | Comparative | 8.00 | None | — | 84.5 | 7.5 |
| 2-2 | Comparative | 8.00 | None | 0.73 | 83.8 | 7.5 |
| 2-3 | Inventive | 8.00 | None | 0.73 | 83.8 | 7.5 |
| 2-4 | Inventive | 8.00 | None | 0.73 | 83.8 | 7.5 |
| 2-5 | Inventive | 8.00 | None | 0.73 | 83.8 | 7.5 |
| 2-6 | Inventive | 8.00 | None | 0.73 | 83.8 | 7.5 |
| 2-7 | Inventive | 8.00 | None | None | 84.5 | 7.5 |
| 2-8 | Inventive | 8.00 | None | 0.73 | 83.8 | 7.5 |
| 2-9 | Inventive | 7.52 | 0.48 | 0.73 | 83.8 | 7.5 |
| 2-10 | Inventive | 8.00 | None | None | 84.5 | 7.5 |
| 2-11 | Inventive | 8.00 | None | 0.73 | 83.8 | 7.5 |
| 2-12 | Inventive | 7.52 | 0.48 | 0.73 | 83.8 | 7.5 |
| 2-13 | Inventive | None | 8.00 | None | 84.5 | 7.5 |

TABLE V

Adhesion and Sensitometric Properties of Photothermographic Material

| | | Adhesion Interlayer to Emulsion Layer Three Tape | Adhesion Interlayer to Overcoat Layer Three Tape | Dmin % Haze | Sensitometry (Processed for 15 s at 122.5° C.) | | | |
|---|---|---|---|---|---|---|---|---|
| Sample# | Description | Lift-Off Test | Lift-Off Test | Processed | Dmin | Dmax/Ag | Spd-3 | AC-1 |
| 2-1 | Comparative | 0 | — | 18.0 | 0.229 | 1.82 | 1.047 | 3.766 |
| 2-2 | Comparative | 2 | — | 16.7 | 0.214 | 1.82 | 1.138 | 4.318 |
| 2-3 | Inventive | 4 | 5 | 17.3 | 0.216 | 1.88 | 1.332 | 4.500 |
| 2-4 | Inventive | 4 | 5 | 17.1 | 0.214 | 1.89 | 1.244 | 4.455 |
| 2-5 | Inventive | 5 | 5 | 17.3 | 0.234 | 1.88 | 1.224 | 4.303 |
| 2-6 | Inventive | 5 | 5 | 17.6 | 0.227 | 1.83 | 1.272 | 4.570 |
| 2-7 | Inventive | 5 | 5 | 18.3 | 0.222 | 1.95 | 1.382 | 5.139 |
| 2-8 | Inventive | 5 | 5 | 18.6 | 0.222 | 1.85 | 1.329 | 5.201 |
| 2-9 | Inventive | 5 | 5 | 18.7 | 0.243 | 1.87 | 1.343 | 5.039 |
| 2-10 | Inventive | 5 | 5 | 19.5 | 0.247 | 1.88 | 1.299 | 5.043 |
| 2-11 | Inventive | 5 | 5 | 18.9 | 0.244 | 1.89 | 1.292 | 5.022 |
| 2-12 | Inventive | 5 | 5 | 18.6 | 0.246 | 1.86 | 1.186 | 4.680 |
| 2-13 | Inventive | 5 | 5 | 18.6 | 0.243 | 1.69 | 1.137 | 5.245 |

EXAMPLE 3

Preparation of Photothermographic Emulsion Formulation:

A preformed silver halide, silver carboxylate soap dispersion, was prepared as described above in Example 1.

A photothermographic emulsion formulation was prepared from this soap dispersion as described above in Example 1, except that 0.007 parts of Sensitizing Dye A and 3.7 parts of MEK were added.

The emulsion formulation was completed by adding the materials and in the manner described above for preparing Solution A of Example 1.

Preparation of Overcoat Formulations:

Overcoat D—Inventive:

Inventive overcoat formulations consisting of Cellulose Acetate and an alkyl vinyl ether/maleic anhydride copolymer were prepared by mixing the following materials:

| | |
|---|---|
| MEK | 169.9 parts |
| Acetone | 13.59 parts |
| GANTREZ ® AN-169 | 2.90 parts |
| Cellulose Acetate (CA398-6) resin | 11.59 parts |
| Vinyl Sulfone VS-1 | 0.55 parts, 80.21% active |
| Benzotriazole (BZT) | 0.329 parts |
| Acutance Dye AD-1 | 0.168 parts |
| Antifoggant AF-B | 0.29 parts |
| Tinting Dye TD-1 | 0.0071 parts |
| SYLYSIA ® 310P Premix | 8.37 parts |

The SYLYSIA® 310P premix was prepared by mixing the following materials:

| | |
|---|---|
| MEK | 46.499 parts |
| CAB 171-15S | 1.909 parts |
| SYLYSIA ® | 1.591 parts |

This premix was mixed with a high sheer mixer for 5 minutes.

The final overcoat formulation was prepared by adding 17.92 parts of the Overcoat D containing the weight ratios of various surfactants as shown in TABLE VI.

Preparation of Photothermographic Materials:

The photothermographic emulsion and overcoat formulations were simultaneously coated onto a 7 mil (178 μm) polyethylene terephthalate support, tinted blue with support dye SD-1. An automated dual knife coater was used. Immediately after coating, samples were dried in a forced air oven at 92° C. for 6 minutes. The photothermographic emulsion formulation was coated to obtain a coating weight of between about 1.9 and 2.0 g of total silver/$m^2$. The overcoat formulation was coated to obtain a dry coating weight of about 0.2 g/$ft^2$ (2.2 g/$m^2$) and an absorbance in the imaging layer between 0.95 and 1.05 at 810 nm.

The backside of the support had been coated with an antihalation and antistatic layer having an absorbance greater than 0.3 between 805 and 815 nm, and a resistivity of $10^{11}$ ohms/square or less at 21.1° C. and 50% relative humidity and an outermost backside layer.

Testing of Photothermographic Materials:

Measurement of Adhesion:

Adhesion of the overcoat was measured as described above in Example 1. In this example where surfactants were used in preparing the overcoat solution, the "lift-off" of the tape was repeated three times so that any surfactant residue on the overcoat surface could be removed from the first two "lift-offs". The results of the first and third tape lift-off test were recorded.

Measurement of Haze:

Haze of samples was measured as described in Example 1.

Sensitometry:

Sensitometry of samples was evaluated as described in Example 1.

Calculation of Silver Efficiency:

Silver efficiency of samples was determined as described in Example 1.

Results:

The results are shown below in TABLE VII. The adhesion values for Samples 3-1 and 3-2 after the one tape lift-off test were 2.5 or greater which demonstrates adequate adhesion between the overcoat and emulsion layer. Also notice that for Samples 3-3 to 3-10 the adhesion values increased with the addition of the surfactants. With the more aggressive three tape lift-off test, Samples 3-1 and 3-2 demonstrate that protective overcoats containing only a cellulose acetate polymer (CA398-6) and an alkyl vinyl ether/maleic anhydride copolymer (GANTREZ® AN-169) suffer from poorer adhesion when compared with identically prepared Samples 3-3 to 3-10 in which surfactants were added.

Thus, Samples 3-3 to 3-10 demonstrate that inventive overcoats containing surfactants with a mixture of cellulose acetate and an alkyl vinyl ether/maleic anhydride exhibit further improved adhesion to the emulsion layer.

Additionally, the low haze values for protective overcoats comprising surfactants and a mixture of cellulose acetate and alkyl vinyl ether/maleic anhydride copolymer are similar to those of a combination of cellulose acetate and an alkyl vinyl ether/maleic anhydride copolymer used alone. This indicates the good compatibility of surfactants with mixtures of cellulose acetate and alkyl vinyl ether/maleic anhydride copolymers.

Finally, the sensitomeric properties of samples containing an overcoat comprising a surfactant and a mixture of cellulose acetate and alkyl vinyl ether/maleic anhydride copolymer are comparable to samples containing an overcoat of cellulose acetate and an alkyl vinyl ether/maleic anhydride alone.

TABLE VI

Chemical Composition of Overcoat Solutions (in parts).

| Sample# | Description | Unidyne NS-1602 | Surflon S-386 | Masurf FS-910 | Zonyl 9360 | Zonyl 8867L | Masurf FP-320 | Masurf FS-810 |
|---|---|---|---|---|---|---|---|---|
| 3-1 | Inventive | — | — | — | — | — | — | — |
| 3-2 | Inventive | — | — | — | — | — | — | — |
| 3-3 | Inventive | 0.109 | — | — | — | — | — | — |
| 3-4 | Inventive | — | 0.050 | — | — | — | — | — |

TABLE VI-continued

Chemical Composition of Overcoat Solutions (in parts).

| Sample# | Description | Unidyne NS-1602 | Surflon S-386 | Masurf FS-910 | Zonyl 9360 | Zonyl 8867L | Masurf FP-320 | Masurf FS-810 |
|---|---|---|---|---|---|---|---|---|
| 3-5 | Inventive | — | — | 0.022 | — | — | — | — |
| 3-6 | Inventive | — | — | — | 0.021 | | — | — |
| 3-7 | Inventive | — | — | — | — | 0.021 | — | — |
| 3-8 | Inventive | — | — | — | — | | 0.011 | — |
| 3-9 | Inventive | — | — | — | — | — | 0.023 | — |
| 3-10 | Inventive | — | — | — | — | — | — | 0.231 |

TABLE VII

Adhesion and Sensitometric Properties of Photothermographic Material.

| Sample# | Description | Adhesion Unprocessed One Tape Lift-Off Test | Adhesion Unprocessed Three Tape Lift-Off Test | Dmin % Haze Processed | Sensitometry (Processed for 15 s at 122.5° C.) Dmin | Dmax/Ag | Spd-3 | AC-1 |
|---|---|---|---|---|---|---|---|---|
| 3-1 | Inventive | 2.5 | 0 | 21.9 | 0.225 | 2.00 | 1.27 | 4.28 |
| 3-2 | Inventive | 3 | 0 | 22.9 | 0.225 | 1.90 | 1.27 | 4.57 |
| 3-3 | Inventive | 5 | 5 | 23.1 | 0.226 | 1.91 | 1.24 | 4.30 |
| 3-4 | Inventive | 5 | 2 | 22.4 | 0.227 | 1.99 | 1.23 | 4.16 |
| 3-5 | Inventive | 5 | 3 | 22.5 | 0.227 | 1.93 | 1.22 | 4.14 |
| 3-6 | Inventive | 5 | 2.5 | 21.8 | 0.225 | 1.90 | 1.23 | 4.21 |
| 3-7 | Inventive | 4 | 2 | 21.5 | 0.226 | 1.93 | 1.23 | 4.17 |
| 3-8 | Inventive | 5 | 1 | 21.6 | 0.225 | 1.98 | 1.26 | 4.45 |
| 3-9 | Inventive | 5 | 2 | 22.2 | 0.227 | 1.91 | 1.26 | 4.34 |
| 3-10 | Inventive | 5 | 5 | 22.0 | 0.225 | 1.88 | 1.16 | 4.07 |

EXAMPLE 4

Preparation of Photothermographic Emulsion Formulation:

A photothermographic emulsion formulation was prepared as described in Example 3.

Preparation of Overcoat Formulations:

Overcoat E—Comparative:

Comparative overcoat formulations consisting only of Cellulose Acetate as the binder were prepared by mixing the following materials:

| | |
|---|---|
| MEK | 169.9 parts |
| Acetone | 13.59 parts |
| CA398-6 resin | 14.49 parts |
| Vinyl Sulfone VS-1 | 0.55 parts, 80.21% active |
| Benzotriazole (BZT) | 0.329 parts |
| Acutance Dye AD-1 | 0.168 parts |
| Antifoggant AF-B | 0.29 parts |
| Tinting Dye TD-1 | 0.0071 parts |
| SYLYSIA ® 310P Premix | 10.45 parts |

The SYLYSIA® 310P premix was prepared by mixing the following materials:

| | |
|---|---|
| MEK | 46.499 parts |
| CAB 171 15S | 1.909 parts |
| SYLYSIA ® 310P | 1.591 parts |

This premix was mixed with a high sheer mixer for 5 minutes.

Overcoat F—Inventive:

Inventive overcoat formulations consisting of Cellulose Acetate and an alkyl vinyl ether/maleic anhydride copolymer were prepared by mixing the following materials:

| | |
|---|---|
| MEK | 169.9 parts |
| Acetone | 13.59 parts |
| GANTREZ ® AN-169 | 0.72 parts |
| Cellulose Acetate (CA398-6) resin | 13.77 parts |
| Vinyl Sulfone VS-1 | 0.55 parts, 80.21% active |
| Benzotriazole (BZT) | 0.329 parts |
| Acutance Dye AD-1 | 0.168 parts |
| Antifoggant AF-B | 0.29 parts |
| Tinting Dye TD-1 | 0.0071 parts |
| SYLYSIA ® 310 Premix | 9.93 parts |

The SYLYSIA® 310 premix was prepared by mixing the following materials:

| | |
|---|---|
| MEK | 46.499 parts |
| CAB 171 15S | 1.909 parts |
| SYLYSIA ® 310P | 1.591 parts |

This premix was mixed with a high sheer mixer for 5 minutes.

The final overcoat formulation was prepared by adding 17.37 parts of the Overcoat E formulation or 18.23 parts of the Overcoat F formulation to the weight ratios of various surfactants as shown in TABLE VIII.

Preparation of Photothermographic Materials:

The photothermographic emulsion and overcoat formulations were simultaneously coated onto a support as described in Example 3. The photothermographic emulsion formulation was coated to obtain a coating weight of between 1.95 and 2.05 g of total silver/$m^2$.

Testing of Photothermographic Materials:

Measurement of Adhesion:

Adhesion of the overcoat was measured as described above in Example 1. However, in this example in which these samples where surfactants were used in the overcoat solution, the "lift-off" of the tape was repeated three times so that any surfactant residue on the overcoat surface could be removed from the first two "lift-offs". The results of the first and of third tape test were recorded.

Measurement of Haze:

Haze of samples was measured as described in Example 1.

Sensitometry:

Sensitometry of samples was evaluated as described in Example 1.

Calculation of Silver Efficiency:

Silver efficiency of samples was determined as described in Example 1.

Measurement of Tribocharging of the Overcoat Samples measuring 3"×3" square were cut from coated films and preconditioned at 70° C./20% RH for at least 16 hours prior to testing. The test sample was then mounted with the side to be measured facing out from a Silastone granite block weighing approximately 236 g using 3M photo mount spray adhesive #6094. The block and sample was then deionized in an ionizing air blower for about 5 seconds prior to testing. This block, with the sample facing the material to be tribocharged against (a 3.5 by 12" sample size), was then placed on top of a conveyor belt material that was clamped on an insulated test bed. After releasing the catch, the conveyor belt test bed was slid away from the test sample for a length of 33 cm and the test sample attached to the block was dropped into a Faraday cup. The triboelectric charge generated on the sample surface (the overcoat) was then measured using a Keithely Electrometer High Resistance Meter. Tribocharge is reported in microCoulombs per square meter ($\mu C/m^2$).

The following conveyor belt materials were used in the test:

(1) Belt A: Habasit BS-EAT-8P from Belt Power LLC (Smyrna, Ga.).

(2) Belt B: Habasit BS-MAM-04H from Belt Power LLC (Smyrna, Ga.).

Results:

The results are shown below in TABLE IX. A comparison of Sample 4-1 with Samples 4-2 and 4-3 (replicates) demonstrates that protective overcoats containing a cellulose acetate polymer (CA398-6) and an alkyl vinyl ether/maleic anhydride copolymer (GANTREZ® AN-169) provide better adhesion than similarly prepared overcoats containing only cellulose acetate (CA398-6) with the one tape "lift-off" test.

Samples 4-5, 4-7, 4-9, 4-11, 4-13, 4-15, 4-17, and 4-19 demonstrate that inventive overcoats containing a surfactant in combination with a mixture of cellulose acetate and an alkyl vinyl ether/maleic anhydride copolymer exhibit improved adhesion to the emulsion layer by the one tape lift-off test or Samples 4-5, 4-11, 4-13, 4-15, 4-17, and 4-19 by the three tape lift-offtest.

The addition of surfactants also improves adhesion of cellulose acetate only overcoats as demonstrated in Samples 4-4, 4-6, 4-8, 4-10, 4-12, 4-14, 4-16, and 4-18 by the one tape lift-off test.

Additionally, the low haze values for protective overcoats comprising a surfactant in combination with cellulose acetate and an alkyl vinyl ether/maleic anhydride copolymer are similar to those of cellulose acetate either used alone or mixed with an alkyl vinyl ether/maleic anhydride copolymer. This indicates the good compatibility of surfactants with a mixture of cellulose acetate and an alkyl vinyl ether/maleic anhydride copolymer.

The sensitomeric properties of samples having an overcoat comprising a mixture of a surfactant with cellulose acetate and an alkyl vinyl ether/maleic anhydride copolymer are comparable to samples containing an overcoat of only cellulose acetate or a mixture of cellulose acetate and an alkyl vinyl ether/maleic anhydride copolymer.

Finally, the tribocharging results, shown below in TABLE X demonstrate that the addition of surfactants to a mixture of cellulose acetate and an alkyl vinyl ether/maleic anhydride copolymer decreases or minimized the tribocharging effects. Sample 4-17 which contained a surfactant in combination with a mixture of cellulose acetate and an alkyl vinyl ether/maleic anhydride copolymer had a lower charge (in $\mu C/m^2$), than identically prepared Samples 4-2 and 4-3 that contained only a mixture of cellulose acetate and an alkyl vinyl ether/maleic anhydride copolymer.

TABLE VIII

Chemical Composition of Overcoat Solutions (in parts).

| Sample# | Description | Overcoat | Unidyne NS-1602 | Surflon S-386 | Masurf FS-910 | Zonyl 9360 | Zonyl 8867L | Masurf FP-320 | Ciba EFKA 3277 | Masurf FS-810 |
|---|---|---|---|---|---|---|---|---|---|---|
| 4-1 | Comparative | E | — | — | — | — | — | — | — | — |
| 4-2 | Inventive | F | — | — | — | — | — | — | — | — |
| 4-3 | Inventive | F | — | — | — | — | — | — | — | — |
| 4-4 | Comparative | E | 0.114 | — | — | — | — | — | — | — |
| 4-5 | Inventive | F | 0.114 | — | — | — | — | — | — | — |
| 4-6 | Comparative | E | — | 0.059 | — | — | — | — | — | — |
| 4-7 | Inventive | F | — | 0.059 | — | — | — | — | — | — |
| 4-8 | Comparative | E | — | — | 0.054 | — | — | — | — | — |
| 4-9 | Inventive | F | — | — | 0.054 | — | — | — | — | — |
| 4-10 | Comparative | E | — | — | — | 0.029 | — | — | — | — |
| 4-11 | Inventive | F | — | — | — | 0.029 | — | — | — | — |
| 4-12 | Comparative | E | — | — | — | — | 0.030 | — | — | — |
| 4-13 | Inventive | F | — | — | — | — | 0.030 | — | — | — |
| 4-14 | Comparative | E | — | — | — | — | — | 0.027 | — | — |
| 4-15 | Inventive | F | — | — | — | — | — | 0.027 | — | — |

TABLE VIII-continued

Chemical Composition of Overcoat Solutions (in parts).

| Sample# | Description | Overcoat | Unidyne NS-1602 | Surflon S-386 | Masurf FS-910 | Zonyl 9360 | Zonyl 8867L | Masurf FP-320 | Ciba EFKA 3277 | Masurf FS-810 |
|---|---|---|---|---|---|---|---|---|---|---|
| 4-16 | Comparative | E | — | — | — | — | — | — | 0.120 | — |
| 4-17 | Inventive | F | — | — | — | — | — | — | 0.120 | — |
| 4-18 | Comparative | E | — | — | — | — | — | — | — | 0.284 |
| 4-19 | Inventive | F | — | — | — | — | — | — | — | 0.279 |

TABLE IX

Adhesion and Sensitometric Properties of Photothermographic Material.

| Sample# | Description | Adhesion Unprocessed Three Tape Lift-Off Test | Adhesion Unprocessed Three Tape Lift-Off Test | Dmin % Haze Processed | Sensitometry (Processed for 15 s at 122.5° C.) Dmin | Dmax/Ag | Spd-3 | AC-1 |
|---|---|---|---|---|---|---|---|---|
| 4-1 | Comparative | 0 | 0 | 22.9 | 0.222 | 1.94 | 1.28 | 3.74 |
| 4-2 | Inventive | 2 | 0 | 20.8 | 0.221 | 1.96 | 1.28 | 3.87 |
| 4-3 | Inventive | 2 | 0 | 21.5 | 0.221 | 1.97 | 1.27 | 3.88 |
| 4-4 | Comparative | 4 | 2 | 22.7 | 0.225 | 1.95 | 1.31 | 3.71 |
| 4-5 | Inventive | 5 | 4 | 21.7 | 0.222 | 1.94 | 1.28 | 3.87 |
| 4-6 | Comparative | 2 | 0 | 22.4 | 0.224 | 1.96 | 1.30 | 3.70 |
| 4-7 | Inventive | 3 | 0 | 21.3 | 0.222 | 1.95 | 1.26 | 3.91 |
| 4-8 | Comparative | 2 | 0 | 25.5 | 0.214 | 1.93 | 1.19 | 3.72 |
| 4-9 | Inventive | 3 | 0 | 21.9 | 0.221 | 1.88 | 1.28 | 3.93 |
| 4-10 | Comparative | 3 | 0 | 22.4 | 0.221 | 2.01 | 1.28 | 3.71 |
| 4-11 | Inventive | 5 | 2 | 21.2 | 0.220 | 1.92 | 1.29 | 4.07 |
| 4-12 | Comparative | 2 | 0 | 22.1 | 0.222 | 1.93 | 1.27 | 3.55 |
| 4-13 | Inventive | 4 | 3 | 20.9 | 0.220 | 1.93 | 1.27 | 3.97 |
| 4-14 | Comparative | 2 | 0 | 22.5 | 0.222 | 1.95 | 1.33 | 3.90 |
| 4-15 | Inventive | 4 | 2 | 20.5 | 0.218 | 1.98 | 1.33 | 4.15 |
| 4-16 | Comparative | 3 | 1 | 23.0 | 0.225 | 1.98 | 1.30 | 3.65 |
| 4-17 | Inventive | 4 | 2 | 21.5 | 0.224 | 1.92 | 1.28 | 3.93 |
| 4-18 | Comparative | 5 | 3 | 21.9 | 0.224 | 1.96 | 1.23 | 3.57 |
| 4-19 | Inventive | 5 | 5 | 20.9 | 0.225 | 1.93 | 1.30 | 4.04 |

TABLE X

Tribocharging Properties of Photothermographic Material.

| Sample# | Description | Belt A ($\mu C/m^2$) | Belt B ($\mu C/m^2$) |
|---|---|---|---|
| 4-2 | Inventive | −3.13 | −3.45 |
| 4-3 | Inventive | −2.31 | −3.81 |
| 4-17 | Inventive | 0.41 | −3.13 |

EXAMPLE 5

Preparation of Photothermographic Emulsion Formulation:

A photothermographic emulsion formulation was prepared as described in Example 3.

Preparation of Overcoat Formulations:

Overcoat G—Comparative:

Comparative overcoat formulations consisting of Cellulose Acetate were prepared by mixing the following materials:

| | |
|---|---|
| MEK | 169.9 parts |
| Acetone | 13.59 parts |
| CA398-6 resin | 14.49 parts |

-continued

| | |
|---|---|
| Vinyl Sulfone VS-1 | 0.55 parts, 80.21% active |
| Benzotriazole (BZT) | 0.329 parts |
| Acutance Dye AD-1 | 0.168 parts |
| Antifoggant AF-B | 0.29 parts |
| Tinting Dye TD-1 | 0.0071 parts |
| SYLYSIA ® 310P Premix | 8.37 parts |

The SYLYSIA® 310P premix was prepared by mixing the following materials:

| | |
|---|---|
| MEK | 44.71 parts |
| Acetone | 1.79 parts |
| CA 398-6 resin | 1.91 parts |
| SYLYSIA ® 310P | 1.591 parts |

This premix was mixed with a high sheer mixer for 5 minutes.

Overcoat H—Inventive:

Inventive overcoat formulations consisting of Cellulose Acetate and an alkyl vinyl ether/maleic anhydride copolymer and were prepared by mixing the following materials:

| | |
|---|---|
| MEK | 169.9 parts |
| Acetone | 13.59 parts |
| GANTREZ ® AN-169 | 0.72 parts |
| Cellulose Acetate (CA398-6) resin | 13.77 parts |
| Vinyl Sulfone VS-1 | 0.55 parts, 80.21% active |
| Benzotriazole (BZT) | 0.329 parts |
| Acutance Dye AD-1 | 0.168 parts |
| Antifoggant AF-B | 0.29 parts |
| Tinting Dye TD-1 | 0.0071 parts |
| SYLYSIA ® 310P Premix | 8.37 parts |

The SYLYSIA® 310P premix was prepared by mixing the following materials:

| | |
|---|---|
| MEK | 44.71 parts |
| Acetone | 1.79 parts |
| CA 398-6 resin | 1.81 parts |
| GANTREZ ® AN-169 | 0.095 parts |
| SYLYSIA ® 310P | 1.591 parts |

This premix was mixed with a high sheer mixer for 5 minutes.

The final overcoat formulation was prepared by adding 17.20 parts of the Overcoat G or 18.10 parts of the Overcoat H with the weight ratios of various surfactants as shown in TABLE XI.

Preparation of Photothermographic Materials:

The photothermographic emulsion and overcoat formulations were simultaneously coated onto a support as described in Example 3. The photothermographic emulsion formulation was coated to obtain a dry coating weight of between 1.95 and 2.05 g of total silver/$m^2$.

Testing of Photothermographic Materials:

Measurement of Adhesion:

Adhesion of the overcoat was measured as described above in Example 1. However, in this example, where surfactants were used in the overcoat solution, the lift-off of the tape was repeated three times so that any surfactant residue on the overcoat surface could be removed from the first two "lift-offs". The results of the first and of third tape test were recorded.

Measurement of Haze:

Haze of samples was measured as described in Example 1.

Sensitometry:

Sensitometry of samples was evaluated as described in Example 1.

Calculation of Silver Efficiency:

Silver efficiency of samples was determined as described in Example 1.

Results:

The results are shown below in TABLE XII. A comparison of Sample 5-1 to Samples 5-2 and 5-3 (replicates) demonstrates that protective overcoats containing cellulose acetate polymer (CA398-6) and an alkyl vinyl ether/maleic anhydride copolymer (GANTREZ® AN-169) provide better adhesion than similarly prepared overcoats containing only cellulose acetate (CA398-6) with the one tape lift-off test.

Samples 5-5, 5-7, 5-9, 5-11, 5-13 and to 5-15 demonstrate that inventive overcoats containing a mixture of cellulose acetate and an alkyl vinyl ether/maleic anhydride with surfactants exhibit improved adhesion to the emulsion layer by the one tape or three tape lift-off test.

The addition of surfactants also improves the adhesion of the cellulose acetate only overcoats as shown in Samples 5-4, 5-8, 5-10, 5-12 and 5-14 by the one tape or three tape lift-off test.

Additionally, the low haze values for protective overcoats comprising a surfactant in combination with cellulose acetate and an alkyl vinyl ether/maleic anhydride copolymer are similar to those of cellulose acetate either used alone or mixed with an alkyl vinyl ether/maleic anhydride copolymer. This indicates the good compatibility of surfactants with a mixture of cellulose acetate and an alkyl vinyl ether/maleic anhydride copolymer.

The sensitomeric properties of samples having an overcoat comprising a mixture of a surfactant with cellulose acetate and an alkyl vinyl ether/maleic anhydride copolymer are comparable to samples containing an overcoat of only cellulose acetate or a mixture of cellulose acetate and an alkyl vinyl ether/maleic anhydride copolymer.

TABLE XI

Chemical Composition of Overcoat Solutions (in parts).

| Sample | Description | Overcoat | Unidyne NS-1602 | Larostat 902A | Zonyl 9360 | Masurf FP-320 | EFKA 3277 | Masurf FS-810 |
|---|---|---|---|---|---|---|---|---|
| 5-1 | Comparative | G | — | — | — | — | — | — |
| 5-2 | Inventive | H | — | — | — | — | — | — |
| 5-3 | Inventive | H | — | — | | — | — | — |
| 5-4 | Comparative | G | 0.122 | — | — | — | — | — |
| 5-5 | Inventive | H | 0.125 | — | — | — | — | — |
| 5-6 | Comparative | G | — | 0.182 | — | — | — | — |
| 5-7 | Inventive | H | — | 0.183 | — | — | — | — |
| 5-8 | Comparative | G | — | — | 0.041 | — | — | — |
| 5-9 | Inventive | H | | — | 0.039 | — | — | — |
| 5-10 | Comparative | G | — | — | — | 0.040 | — | — |
| 5-11 | Inventive | H | — | — | — | 0.042 | — | — |
| 5-12 | Comparative | G | — | — | — | — | 0.180 | — |
| 5-13 | Inventive | H | — | — | — | — | 0.180 | — |
| 5-14 | Comparative | G | — | — | — | — | — | 0.275 |
| 5-15 | Inventive | H | — | — | — | — | — | 0.276 |

TABLE XII

Adhesion and Sensitometric Properties of Photothermographic Material.

| Sample# | Description | Adhesion Unprocessed One Tape Lift-Off Test | Adhesion Unprocessed Three Tape Lift-Off Test | Dmin % Haze Processed | Sensitometry (Processed for 15 s at 122.5° C.) Dmin | Dmax/Ag | Spd-3 | AC-1 |
|---|---|---|---|---|---|---|---|---|
| 5-1 | Comparative | 1 | 0 | 22.5 | 0.226 | 2.01 | 1.33 | 4.02 |
| 5-2 | Inventive | 2.5 | 0 | 20.0 | 0.222 | 1.93 | 1.25 | 3.97 |
| 5-3 | Inventive | 2 | 0 | 20.4 | 0.224 | 1.93 | 1.24 | 3.97 |
| 5-4 | Comparative | 4 | 2 | 20.8 | 0.226 | 1.98 | 1.31 | 3.71 |
| 5-5 | Inventive | 5 | 5 | 20.1 | 0.220 | 1.95 | 1.31 | 4.10 |
| 5-6 | Comparative | 0 | 0 | 21.5 | 0.224 | 1.91 | 1.21 | 3.69 |
| 5-7 | Inventive | 3 | 1 | 20.2 | 0.221 | 2.06 | 1.19 | 3.92 |
| 5-8 | Comparative | 4 | 2 | 21.4 | 0.228 | 1.98 | 1.28 | 3.75 |
| 5-9 | Inventive | 5 | 4 | 19.4 | 0.224 | 1.95 | 1.26 | 4.09 |
| 5-10 | Comparative | 4 | 2 | 21.7 | 0.230 | 1.94 | 1.31 | 3.89 |
| 5-11 | Inventive | 5 | 3 | 20.1 | 0.227 | 2.01 | 1.28 | 4.14 |
| 5-12 | Comparative | 3 | 1 | 23.3 | 0.229 | 1.96 | 1.26 | 3.74 |
| 5-13 | Inventive | 4 | 2 | 21.5 | 0.227 | 1.96 | 1.30 | 4.09 |
| 5-14 | Comparative | 4 | 2 | 21.6 | 0.230 | 1.95 | 1.29 | 3.78 |
| 5-15 | Inventive | 5 | 5 | 20.2 | 0.227 | 1.96 | 1.32 | 4.17 |

The invention has been described in detail with particular reference to a presently preferred embodiment, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

The invention claimed is:

1. A thermally developable organic-solvent based material that comprises a support having on at least one side thereon, one or more organic-solvent coated buried thermally developable imaging layers comprising a polyvinyl acetal binder, and in reactive association, a non-photosensitive source of reducible silver ions, and a reducing agent composition for said non-photosensitive source reducible silver ions, and having disposed over the one or more organic-solvent coated buried thermally developable imaging layers, an outermost organic-solvent coated overcoat layer comprising a mixture of a cellulose acetate polymer and one or more of an alkyl vinyl ether/maleic anhydride copolymer or an alkylethylene/maleic anhydride copolymer or mixtures thereof.

2. The thermally developable material of claim 1 wherein said polyvinyl acetal binder is polyvinyl butyral.

3. The thermally developable material of claim 1 wherein said alkyl group of said alkyl vinyl ether/maleic anhydride copolymer contains from about 1 to about 4 carbon atoms.

4. The thermally developable material of claim 1 wherein said alkylethylene group of said alkylethylene/maleic anhydride copolymer contains from about 6 to about 18 carbon atoms.

5. The thermally developable material of claim 1 wherein said outermost overcoat layer further comprises a surfactant.

6. The thermally developable material of claim 5 wherein said surfactant is present in an amount of from about 0.01% to about 1.0% based on the total weight percent of all components in the overcoat formulation.

7. The thermally developable material of claim 5 wherein said surfactant is a fluorosurfactant.

8. The thermally developable material of claim 1 wherein the dry thickness of said outermost overcoat layer is from about 1 μm to about 3 μm.

9. The thermally developable material of claim 1 wherein said one or more thermally developable imaging layers is a photothermographic emulsion layer that further comprises a photosensitive silver halide.

10. The thermally developable material of claim 1 wherein said non-photosensitive source of reducible silver ions is a silver salt of an aliphatic carboxylic acid or a mixture of silver salts of aliphatic carboxylic acids, at least one of which is silver behenate.

11. The thermally developable material of claim 1 wherein the silver coating weight of said non-photosensitive source of reducible silver ions is from about 1 to less than about 2 g/m$^2$.

12. The thermally developable material of claim 1 further comprising an organic-solvent coated interlayer comprising an alkyl vinyl ether/maleic anhydride copolymer or an alkylethylene/maleic anhydride copolymer or mixtures thereof that is located between said thermally developable layer(s) and the outermost overcoat layer.

13. The thermally developable material of claim 1 further comprising an organic-solvent coated interlayer comprising a mixture of a cellulose acetate polymer and one or more of an alkyl vinyl ether/maleic anhydride copolymer or an alkylethylene/maleic anhydride copolymer or mixtures thereof.

14. A thermally developable organic-solvent based material that comprises a support having on at least one side thereon, one or more organic-solvent coated buried thermally developable imaging layers comprising a polyvinyl acetal binder, and in reactive association, a non-photosensitive source of reducible silver ions, and a reducing agent composition for said non-photosensitive source reducible silver ions, and having disposed over the one or more organic-solvent coated buried thermally developable imaging layers, an outermost organic-solvent coated overcoat layer comprising a cellulose acetate polymer, and having an interlayer comprising an organic-solvent coated alkyl vinyl ether/maleic anhydride copolymer or an alkylethylene/maleic anhydride copolymer or mixtures thereof that is located between said thermally developable layer(s) and said outermost overcoat layer.

15. The thermally developable material of claim 14 wherein said polyvinyl acetal binder is polyvinyl butyral.

16. The thermally developable material of claim 14 wherein said alkyl group of said alkyl vinyl ether/maleic anhydride copolymer contains from about 1 to about 4 carbon atoms.

17. The thermally developable material of claim 14 wherein said alkylethylene group of said alkylethylene/maleic anhydride copolymer contains from about 6 to about 18 carbon atoms.

18. The thermally developable material of claim 14 wherein said outermost overcoat layer further comprises a surfactant.

19. The thermally developable material of claim 18 wherein said surfactant is present in an amount of from about 0.01% to about 1.0% based on the total weight percent of all components in the overcoat formulation.

20. The thermally developable material of claim 18 wherein said surfactant is a fluorosurfactant.

21. The thermally developable material of claim 14 wherein the dry thickness of the outermost overcoat layer and the interlayer is from about 1 μm to about 3 μm.

22. The thermally developable material of claim 14 wherein said one or more thermally developable imaging layers is a photothermographic emulsion layer that further comprises a photosensitive silver halide.

23. The thermally developable material of claim 14 wherein said non-photosensitive source of reducible silver ions is a silver salt of an aliphatic carboxylic acid or a mixture of silver salts of aliphatic carboxylic acids, at least one of which is silver behenate.

24. The thermally developable material of claim 14 wherein the silver coating weight of said non-photosensitive source of reducible silver ions is from about 1 to less than about 2 $g/m^2$.

25. The thermally developable material of claim 14 wherein the interlayer further comprises a cellulose acetate polymer.

26. A black-and-white, organic solvent-based photothermographic material that comprises a support having on an imaging side thereon, one or more organic-solvent coated buried photothermographic emulsion layers, comprising in reactive association:

photosensitive grains of silver bromide or iodobromide that are sensitized to an exposure wavelength of at least 600 nm, one or more silver salts of aliphatic fatty acids including silver behenate, a reducing agent composition comprising a hindered phenol, a hindered bisphenol, or a combination thereof, and a polyvinyl butyral binder, and an outermost organic-solvent coated overcoat layer disposed over said photothermographic emulsion layers, said outermost organic-solvent coated overcoat layer comprising a mixture of cellulose acetate polymer and methyl vinyl ether/maleic anhydride copolymer.

27. The black-and-white, organic solvent-based photothermographic material of claim 26 further having an organic-solvent coated interlayer comprising:

an alkyl vinyl ether/maleic anhydride copolymer or an alkylethylene/maleic anhydride copolymer or mixtures thereof that is located between said thermally developable layer(s) and said outermost overcoat layer.

28. The black-and-white, organic solvent-based photothermographic material of claim 27 wherein the interlayer further comprises a cellulose acetate polymer.

29. The black-and-white, organic solvent-based photothermographic material of claim 26 wherein said outermost overcoat layer further comprises a fluorosurfactant.

* * * * *